US006892973B2

(12) United States Patent
Johansson et al.

(10) Patent No.: US 6,892,973 B2
(45) **Date of Patent: *May 17, 2005**

(54) REFINER DISK SENSOR AND SENSOR REFINER DISK

(75) Inventors: Ola M. Johansson, Brookfield, WI (US); Timothy L. Wulf, Waukesha, WI (US)

(73) Assignee: J&L Fiber Services, Inc., Waukesha, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/340,962

(22) Filed: Jan. 7, 2003

(65) Prior Publication Data

US 2003/0155456 A1 Aug. 21, 2003

Related U.S. Application Data

(63) Continuation of application No. 09/520,778, filed on Mar. 8, 2000, now Pat. No. 6,502,774.

(51) Int. Cl.[7] ..... B02C 25/00
(52) U.S. Cl. ..... 241/261.2; 241/298
(58) Field of Search ..... 702/104; 73/862.623; 241/33, 36, 261.2, 261.3, 296, 297, 298

(56) References Cited

U.S. PATENT DOCUMENTS 1,151,131 A 8/1915 Starliper
2,116,584 A 5/1938 Shelby (Continued)

FOREIGN PATENT DOCUMENTS

CA 2183700 2/1997
CH 546 600 6/1972
DE 2145096 1/1973
EP 0640395 A1 3/1995

(Continued)

OTHER PUBLICATIONS

W.E. Lunan, K.B. Miles and W.D. May, *The Effect of Differential Pressure on Energy Consumption in Thermo-mechanical Pulping*, Journal of Pulp and Paper Science: vol. 11, No. 5, Sep. 1985, pp. J129–J135.

(Continued)

*Primary Examiner*—Mark Rosenbaum
(74) *Attorney, Agent, or Firm*—Michael Best & Friedrich LLP

(57) ABSTRACT

A sensor, sensor disk, sensor measurement correction system, and method used in measuring a parameter in the refining zone. The sensor includes a spacer that spaces its sensing element from the disk. In one preferred embodiment, the spacer is made of an insulating material that insulates the sensing element from the thermal mass of the disk to prevent the thermal mass from affecting sensor measurement. The sensor includes a housing carried by the spacer that, in turn, carries the sensing element. Where the sensing element is a temperature sensing element, the housing is thermally conductive and the housing and spacer enclose the sensing element. Each sensor is disposed in the refining surface, preferably in its own separate bore in the disk and flush with or below axial refiner bar height. Signals from one or more sensors are processed by a processing device linked to a module containing calibration data that is applied to make sensor measurements more accurate. The module holds calibration data from sensors that are precalibrated before the sensor disk in which they are assembled is shipped, along with the module, to a fiber processing plant where the disk is installed in a refiner and the module connected to the processing device. In one preferred embodiment the sensor or sensors are carried by a sensor module that can be a removable segment of a refiner disk.

23 Claims, 10 Drawing Sheets

U.S. PATENT DOCUMENTS

| | | | | | |
|---|---|---|---|---|---|
| 2,335,358 | A | | 11/1943 | Ray | |
| 2,353,444 | A | | 7/1944 | Conradty et al. | |
| 2,843,646 | A | | 7/1958 | Conant | |
| 3,069,752 | A | | 12/1962 | Sherning | |
| 3,091,844 | A | | 6/1963 | Laine | |
| 3,309,031 | A | | 3/1967 | McMahon et al. | |
| 3,379,578 | A | | 4/1968 | McTaggart et al. | |
| 3,466,200 | A | | 9/1969 | Mellor et al. | |
| 3,539,400 | A | | 11/1970 | Pustell | |
| 3,553,827 | A | | 1/1971 | Baker et al. | |
| 3,604,645 | A | | 9/1971 | Keyes, IV | |
| 3,617,006 | A | | 11/1971 | Jones | |
| 3,617,717 | A | | 11/1971 | Smith | |
| 3,650,891 | A | | 3/1972 | Dahlin | |
| 3,711,687 | A | | 1/1973 | Stout et al. | |
| 3,847,359 | A | | 11/1974 | Holmes et al. | |
| 3,867,205 | A | | 2/1975 | Schley | |
| 3,947,668 | A | | 3/1976 | Al-Shaikh et al. | |
| 4,023,739 | A | | 5/1977 | Lampe et al. | |
| 4,060,716 | A | | 11/1977 | Pekrul et al. | |
| 4,070,761 | A | | 1/1978 | Collins | |
| 4,071,451 | A | | 1/1978 | Wood | |
| 4,148,439 | A | * | 4/1979 | Floden | 241/28 |
| 4,184,204 | A | | 1/1980 | Flohr | |
| 4,211,324 | A | | 7/1980 | Ohlbach | |
| 4,227,927 | A | | 10/1980 | Black et al. | |
| 4,268,381 | A | | 5/1981 | Hooper | |
| 4,313,465 | A | | 2/1982 | Holzem et al. | |
| 4,314,878 | A | | 2/1982 | Lee | |
| 4,430,221 | A | | 2/1984 | Spiewok | |
| 4,454,991 | A | | 6/1984 | Brenholdt | |
| 4,498,137 | A | | 2/1985 | Flohr | |
| 4,581,300 | A | | 4/1986 | Hoppin | |
| 4,581,813 | A | | 4/1986 | Terhune | |
| 4,582,568 | A | | 4/1986 | Iyengar | |
| 4,587,707 | A | | 5/1986 | Nishida et al. | |
| 4,614,296 | A | | 9/1986 | Lesgourgues | |
| 4,626,318 | A | | 12/1986 | Prough et al. | |
| 4,627,578 | A | | 12/1986 | Whyte | |
| 4,661,911 | A | | 4/1987 | Ellery, Sr. | |
| 4,670,215 | A | | 6/1987 | Morishita et al. | |
| 4,672,529 | A | | 6/1987 | Kupersmit | |
| 4,673,875 | A | | 6/1987 | Kjellqvist et al. | |
| 4,688,726 | A | | 8/1987 | Brenholdt | |
| 4,730,252 | A | | 3/1988 | Bradshaw | |
| 4,745,254 | A | | 5/1988 | Funk | |
| 4,820,980 | A | | 4/1989 | Dodson-Edgars | |
| 4,837,417 | A | | 6/1989 | Funk | |
| 4,858,103 | A | | 8/1989 | Takeuchi et al. | |
| 4,878,020 | A | | 10/1989 | Kärnä et al. | |
| 4,887,208 | A | | 12/1989 | Schneider et al. | |
| 4,920,488 | A | | 4/1990 | Filley | |
| 4,943,347 | A | | 7/1990 | Floden | |
| 4,950,986 | A | | 8/1990 | Guerrero | |
| 4,972,318 | A | | 11/1990 | Brown et al. | |
| 4,980,123 | A | | 12/1990 | Gedeon et al. | |
| 4,994,971 | A | | 2/1991 | Poelstra | |
| 5,007,985 | A | | 4/1991 | Engstrand et al. | |
| 5,009,774 | A | | 4/1991 | LeBlanc | |
| 5,011,065 | A | | 4/1991 | Musselmann | |
| 5,011,088 | A | | 4/1991 | Savonjousi | |
| 5,011,090 | A | | 4/1991 | Savonjousi | |
| 5,016,824 | A | | 5/1991 | Pietinen et al. | |
| 5,042,726 | A | | 8/1991 | Reinhall | |
| 5,063,380 | A | | 11/1991 | Wakura | |
| 5,064,536 | A | | 11/1991 | Bratten | |
| 5,067,660 | A | | 11/1991 | Reinhall | |
| 5,071,514 | A | | 12/1991 | Francis | |
| 5,081,039 | A | | 1/1992 | Buttke et al. | |
| 5,091,713 | A | | 2/1992 | Horne et al. | |
| 5,233,542 | A | | 8/1993 | Hohner et al. | |
| 5,425,508 | A | | 6/1995 | Chaney | |
| 5,445,328 | A | | 8/1995 | Musselman | |
| 5,491,340 | A | | 2/1996 | Saarinen | |
| 5,500,088 | A | | 3/1996 | Allison et al. | |
| 5,500,735 | A | | 3/1996 | Bentley et al. | |
| 5,544,819 | A | | 8/1996 | Shepherd | |
| 5,555,171 | A | | 9/1996 | Sonehara et al. | |
| 5,581,019 | A | | 12/1996 | Minor et al. | |
| 5,586,305 | A | | 12/1996 | Eidson et al. | |
| 5,600,058 | A | | 2/1997 | Preikschat et al. | |
| 5,601,690 | A | | 2/1997 | Gauld et al. | |
| 5,638,284 | A | | 6/1997 | Helmer et al. | |
| 5,666,493 | A | | 9/1997 | Wojcik et al. | |
| 5,680,320 | A | | 10/1997 | Helmer et al. | |
| 5,682,473 | A | | 10/1997 | Carson et al. | |
| 5,684,247 | A | | 11/1997 | Preikschat | |
| 5,687,098 | A | | 11/1997 | Grumstrup et al. | |
| 5,691,636 | A | | 11/1997 | Allshouse et al. | |
| 5,718,389 | A | | 2/1998 | Finken et al. | |
| 5,745,365 | A | | 4/1998 | Parker | |
| 5,747,707 | A | * | 5/1998 | Johansson et al. | 73/862.623 |
| 5,758,329 | A | | 5/1998 | Wojcik et al. | |
| 5,823,453 | A | | 10/1998 | Garasimowicz | |
| 5,825,653 | A | | 10/1998 | Huovila et al. | |
| 5,966,679 | A | | 10/1999 | Snowbarger et al. | |
| 5,975,438 | A | | 11/1999 | Garasimowicz | |
| 5,991,636 | A | | 11/1999 | Won et al. | |
| 6,024,309 | A | | 2/2000 | Karlström | |
| 6,092,003 | A | | 7/2000 | Hagart-Alexande et al. | |
| D431,826 | S | | 10/2000 | Karlström | |
| 6,157,916 | A | | 12/2000 | Hoffman | |
| 6,200,421 | B1 | | 3/2001 | Meinander | |
| 6,206,309 | B1 | | 3/2001 | Danielsson et al. | |
| 6,290,816 | B1 | | 9/2001 | Graf | |
| 6,314,381 | B1 | | 11/2001 | Johansson | |
| 6,317,701 | B1 | | 11/2001 | Pyotsia et al. | |
| 6,324,490 | B1 | | 11/2001 | Johansson et al. | |
| 6,502,774 | B1 | * | 1/2003 | Johansson et al. | 241/37 |
| 6,587,803 | B2 | * | 7/2003 | Johansson | 702/104 |
| 2001/0032898 | A1 | | 10/2001 | Bankes et al. | |
| 2002/0013635 | A1 | | 1/2002 | Gotou et al. | |

FOREIGN PATENT DOCUMENTS

| | | |
|---|---|---|
| FR | 2339703 | 8/1977 |
| GB | 1 468 649 | 12/1975 |
| GB | 28667 | 1/2001 |
| WO | WO 83/01969 | 6/1983 |
| WO | WO 89/00624 | 1/1989 |
| WO | WO 96/14156 | 5/1996 |
| WO | WO 97/23018 | 6/1997 |
| WO | WO 97/24596 | 7/1997 |
| WO | WO 97/38792 | 10/1997 |
| WO | WO 98/48936 | 11/1998 |
| WO | WO 98/58243 | 12/1998 |

OTHER PUBLICATIONS

K.B. Miles and W.D. May, Pulp and Paper Research Institute of Canada, *Predicting the Performance of a Chip Refiner; A Constitutive Approach*, 1991 International Mechanical Pulping Conference, pp. 295–301.

H.R. Dana, W.D. May, K.B. Miles and B.G. Newman, Pulp and Paper Research Institute of Canada, Pointe Claire, P.Q., *A Study of Steam Flow and Self–Pressurization in Chip Refiners*, Transactions, vol. 1, No. 3, Sep. 1975, pp. 82–88.

K.B. Miles and W.D. May, Pulp and Paper Research Institute of Canada 1989 Annual Meeting, *The Flow of Pulp in Chip Refiners*, pp. A177–A188.

William Herbert and P.G. Marsh, *Mechanics and Fluid Dynamics of a Disk Refiner*, Tappi, vol. 51, No. 5, May 1968, pp. 235–239.

A Master's thesis by Alexander Horch, *Modeling and Control of a Thermo Mechanical Pulp Refiner*, Dec. 7, 1995.

Helmut Becker, Hans Höglund and Göran Tistad, *Frequency and temperature in chip refining*, Paperi ja Puu–Papper och Trä, No. 3, 1977.

D. Atack and M.I. Stationwala, Pulp and Paper Research Institute of Canada, *On the Measurement of Temperature and Pressure in the Refining Zone of an Open Discharge Refiner*, Transactions, vol. 1, No. 3, pp. 71–76, Sep. 1975.

Esko Härkönen, Seppo Routtu, Ari Ruotu and Ola Johansson, *A Theoretical Model for a TMP–Refiner*, Jun. 9–13, 1997, pp. 95–102, 1997 International Pulping Conference, Stockholm, Sweden.

B.G. Newman, M.I. Stationwala and D. Atack, Pulp and Paper Research Institute of Canada, *Analysis of Steam Flow in Disc Refining*, SPCI International Mechanical Pulping Conference, May 6–10, 1985, pp. 60–67.

Per A Gradin, Ola Johansson, Jan–Erik Berg and Staffan Syström, *Measurement of the Power Distribution in a Single Disc Refiner*, J. Pulp Paper Science 25, No. 11: 384–387 (1999).

M.I. Stationwala, D. Atack, J.R. Wood, D.J. Wild, and A. Karnis, Pulp and Paper Research Institute of Canada, *The Effect of Control Variables on Refining Zone Conditions and Pulp Properties*, Pap. Puu 73, No. 1: 62–69 (Jan 1991).

Marc. J. Sabourin, Eric Xu, j. Brad Cort, Ivan Boileau and Andrew Waller, *Optimizing Residence Time, Temperature and Speed to Improve TMP Pulp Properties and Reduce Energy*, Pulp Pap. Can. 98, No. 4: 38–45, Apr. 1997.

K.B. Miles, H.R. Dana and W.D. May, *The Flow of Stream in Chip Refiners*, CCPA Conf. Technol. E. Stivale 55–60 (Jun. 2–5, 1982), pp. 30–42.

Ola Johansson, Mark Frith, Bo Falk and Robert Gareau, *Thermopulp®—Recent Process Developments and Experiences*, 84$^{th}$ Annual Meeting of the Technical Section of the CCPA: Papers Presented Jan. 29–30, 1998, pp. 1–11.

OMEGA Thermocouple Calibrator Handbook (1996).

Ali P. Haapanen, Pulp and Paper Technical Association of Canada 86$^{th}$ Annual Meeting Papers (2000), *On–Line Temperature Measurement for Paper Machine Dryers: A New Way to Monitor and Improve Performance*, pp. B81–B84.

83$^{rd}$ Annual Meeting, Technical Section, Canadian Pulp & Paper Association, Papers Presented on Tuesday and Wednesday, Jan. 28–29, 1997, Preprints A, *Electronic Customer Data Management System*, pp. A53–A56.

OMEGADYNE™ Pressure, Force, Load Torque Databook (1996), *Chapters B, C, D, E, F, G, H, and J*.

Bill Gough, John Kay, and Greg Seebach, Canadian Pulp & Paper Association, Technical Section, 79$^{th}$ Annual Meeting, Preprints A, *Adaptive Control Applications in Pulp and Paper*, pp. A73–A84, Jan. 26–27, 1993.

Luc Charbonneau and Philip Plouffe, Canadian Pulp & Paper Association, Technical Section, 79$^{th}$ Annual Meeting, Preprints A, *Sensodec–10—Condition Monitoring System*, pp. A109–A118, Jan. 26–27, 1993.

M. Spence, K. Danielson, Y. Ying, and M. Rao, Canadian Pulp & Paper Association, Technical Section, 79$^{th}$ Annual Meeting, Preprints A, *On–Line Advisory Expert Development at Daishowa Peace River Pulp*, pp. A143–A147, Jan. 26–27, 1993.

Geoff Lawrence, Canadian Pulp & Paper Association, Technical Section, 79$^{th}$ Annual Meeting, Preprints A, *New Measurement and Control System Allows for Simple and Economical DCS Integration*, pp. A179–A183, Jan. 26–27, 1993.

James J. Pinto and Pierre Gingras, Canadian Pulp & Paper Association, Technical Section, 79$^{th}$ Annual Meeting, Preprints A, "Truly" *Distributed Control Systems—Through Intelligent, Networked I/O*, pp. A291–A294, Jan. 26–27, 1993.

John R. Lavigne, Pulp and Paper Industry Division, *An Introduction to Paper Industry Instrumentation, Revised Edition*, 1977, Chapters 1, 2, 4, 5, 6, 7, 8, 10, 11, 12, 15, 16, 17, 18, 19, and 20.

B.C. Strand and Anders Mokvist, 1991 Int'l Mech. Pulping Conf. Proc., Jun. 2–5, *On–Line Control and Optimization of the Refining Process Using a Model Based Control System*, pp. 101–108.

Jan Hill, Kari Saarinen, and Roger Strenros, 1991 Int'l Mech. Pulping Conf. Proc., Jun. 2–5, *On the control of chip refining systems*, pp. 235–241.

Kenneth W. Britt, Ed., *Handbook of Pulp and Paper Technology*, 2$^{nd}$ Ed. (1970), Chapter 5.

M. Fournier, H. Ma, P.M. Shallhorn, and A.A. Roche, *Control of Chip Refiner Operation*, 1991 Int'l Mech. Pulping Conf. Proc., pp. 91–100.

Daniel Jutras, Steve A. Rowland, Luis Cortez, and Nelson LaFleur, *The Hymac HXD–64: A New Concept in Refiner Design*, 1991 Int'l Mech. Pupling Conf. Proc., pp. 285–294.

M.I. Stationwala, K.B. Miles, and A. Karnis, *The Effect of First Stage Refining Conditions on Pulp Properties and Energy Consumption*, 1991 Int'l Mech. Pupling Conf. Proc., pp. 321–327.

Art. Jepson, New Wave Screen Baskets Upgrade Existing Systems, 1984 Pulping Conf. TAPPI Proc., pp. 515–520.

OMEGA *C01, C02, C03 "Cement–On" Thermocouples User's Guide* (1996).

Lars Johansson, *Effects of Temperature and Sulfonation on Deformation of Spruce Wood*, Thesis for Dept. of Forest Prods. and Chem. Eng'g, Chalmers University of Technology, Göteborg, Sweden (1997).

OMEGA *Transactions in Measurement and Control*, vol. 3: Force–Related Measurements (1998).

Karin Eriksson, Performance Analysis in TMP Refining, Thesis for Dept. of Signals and Systems, Chalmers University of Technology, Göteberg, Sweden (2001).

BeInZero AB Refiner Control System documentation, "Get to Know Your Refiners", pp. 1–19 and appendices 1 and 2 (2000).

Jan Sundholm, *Papermaking Science and Technology, Book 5: Mechanical Pulping* (1999), chapters 1–4 and 7–10.

Lydia Bley and Roland Berger, *Recent Advances in On–Line Charge Measurements*, 2001 Int'l Mech. Pulping Conf. Proc, pp. 63–72.

François Julien Saint Amand and Bernard Perrin, *Fundamental Aspects of Mechanical Pulp Screening*, 2001 Int'l Mech. Pulping Conf. Proc, pp. 387–406.

B.C. Strand, View on Control Development, 2001 Int'l Mech. Pulping Conf. Proc, pp. 477–480.

Karl Mosbye, Kjell–Arve Kure, Guri Fuglem, Ola Johansson, *Use of Refining Zone Temperature Measurements for Refiner Control*, 2001 Int'l Mech. Pulping Conf. Proc., pp. 481–488.

Olof Ferritsius and Rita Ferritsius, *Experiences from Stora Enso Mills of Using Factor Analysis for Control of Pulp and Paper Quality*, 2001 Int'l Mech. Pulping Conf. Proc., pp. 495–503.

Juha Kortelainen, Anitti Salopuro, Jouko Halttunen, *Prediction of TMP Quality Properties with On–Line Measurements*, 2001 Int'l Mech. Pulping Conf. Proc., pp. 505–512.

Ismo Joensuu, Lennart Karlsson, Jaakko Myllyneva, *Fuzzy Quality Control of a TMP Plant*, 2001 Int'l Mech. Pulping Conf. Proc., pp. 513–521.

Lars Sundström, Roy Tönnesen, and Lennart Nilsson, *Multivariate Monitoring of a Chip Feeding Process*, 2001 Int'l Mech. Pulping Conf. Proc., pp. 523–529.

Petteri Vuorio and Peter Bergquist, *New Refiner Segments Technology to Optimize Fiber Quality and Energy Consumption of Refiner Mechanical Pulp*, 2001 Int'l Mech. Pulping Conf. Proc., pp. 565–577.

Ola Johansson, Dan Hogan, Dale Blankenship, Eddie Snow, Wyllys More, Ronnie Qualls, Keith Pugh, and Mike Wanderer, *Improved Process Optimization Through Adjustable Refiner Plates*, 2001 Int'l Mech. Pulping Conf. Proc., pp. 579–589.

Fredrik Rosenqvist, Karin Eriksson, and Anders Karlström, *Time–Variant Modelling of TMP Refining*, undated.

Fredrik Rosenqvist, Karin Eriksson, and Anders Karlström, *Modelling a Thermomechanical Wood–Chip Refiner*, undated.

Plant Information (PI™) System brochure, OSI Software Inc., undated.

* cited by examiner-

| SENSOR | CALIBRATION CONSTANT |
|---|---|
| 1 | 3.1 |
| 2 | -0.7 |
| 3 | 2.2 |
| 4 | 4.3 |
| 5 | -1.5 |
| 6 | 4 |
| 7 | 5 |
| 8 | 3 |

FIG. 12

| SENSOR | SLOPE OFFSET $C_1$ | INTERCEPT OFFSET $C_2$ |
|---|---|---|
| 1 | 0.012 | 2.1 |
| 2 | -0.0021 | 2.25 |
| 3 | -0.010 | -1.6 |
| 4 | 0.102 | -1.2 |
| 5 | 0.110 | 0.7 |
| 6 | 0.015 | 3.1 |
| 7 | -0.212 | 1.6 |
| 8 | 0.005 | 0.02 |

FIG. 13

REFINER DISK SENSOR AND SENSOR REFINER DISK

CROSS REFERENCE TO RELATED APPLICATION

This application is a continuation application of presently U.S. application Ser. No. 09/520,778, filed Mar. 8, 2000 and entitled "Refiner Disk Sensor and Sensor Refiner Disk," now U.S. Pat. No. 6,502,774, the entirety of which is incorporated herein by reference.

FIELD OF THE INVENTION

The present invention relates to a sensor, a sensor refiner disk, a system for increasing the accuracy of a measurement made from a parameter sensed in the refining zone, and a method of improving the accuracy of the measurement made.

BACKGROUND OF THE INVENTION

Many products we use everyday are made from fibers. Examples of just a few of these products include paper, personal hygiene products, diapers, plates, containers, and packaging. Making products from wood fiber, fabric fiber and the like, involves breaking solid matter into fibrous matter. This also involves processing the fibrous matter into individual fibers that become fibrillated or frayed so they more tightly mesh with each other to form a finished fiber product that is desirably strong, tough, and resilient.

In fiber product manufacturing, refiners are used to process the fibrous matter, such as wood chips, fabric, and other types of pulp, into fibers and to further fibrillate existing fibers. The fibrous matter is transported in liquid stock to each refiner using a feed screw driven by a motor.

Each refiner has at least one pair of circular ridged refiner disks that face each other and are driven by one or more motors. During refining, fibrous matter in the stock to be refined is introduced into a gap between the disks that usually is quite small. Relative rotation between the disks during operation fibrillates fibers in the stock as the stock passes radially outwardly between the disks.

One example of a disk refiner is shown and disclosed in U.S. Pat. No. 5,425,508. However, many different kinds of refiners are in use today. For example, there are counter rotating refiners, double disk or twin refiners, and conical disk refiners. Conical disk refiners are often referred to in the industry as CD refiners.

During operation, many refiner parameters are monitored. Examples of parameters include the power of the drive motor that is rotating a rotor carrying at least one refiner disk, the mass flow rate of the stock slurry being introduced into the refiner, the force with which opposed refiner disks are being forced together, the flow rate of dilution water being added in the refiner to the slurry, and the refiner gap.

It has always been a goal to monitor conditions in the refining zone between the pairs of opposed refining disks. However, making such measurements have always been a problem because the conditions in the refining zone are rather extreme, which makes it rather difficult to accurately measure parameters in the refining zone, such as temperature and pressure.

While sensors have been proposed in the past to measure temperature and pressure in the refining zone, they have not heretofore possessed the reliability and robustness to be commercially practicable. Depending on the application, temperature sensors used in the past also lacked the accuracy needed to provide repeatable absolute temperature measurement, something that is highly desirable for certain kinds of refiner control.

Another problem grappled with in the past is how and where to mount sensors. In the past, sensors have been mounted to a bar that is received in a pocket in the refining surface. This mounting technique is undesirable because it reduces total refining surface area and can adversely affect the flow pattern during refining, leading to less intense refining and increased shives.

Hence, while sensors and sensing systems used in the past have proven useful, improvements nonetheless remain desirable.

SUMMARY OF THE INVENTION

A sensor, sensor disk, sensor correction system and method used in making a measurement of a parameter or characteristic sensed in the refining zone of a rotary disk refiner that refines fibrous pulp in a liquid stock slurry.

The sensor disk includes at least one sensor that is embedded in a refining surface of the sensor disk. The sensor disk preferably includes a plurality of spaced apart sensors that are each at least partially embedded in the refining surface. Each sensor preferably is a temperature sensor or a pressure sensor but, in any case, is a sensor capable of sensing a characteristic or parameter of conditions in the refining zone from which a measurement can be made. In one preferred embodiment, the sensor disk has at least three sensors which are radially spaced apart and which can be disposed in a line that extends in a radial direction. Even if not disposed in a line, the sensors preferably are radially distributed along the refining surface.

Each sensor is disposed in its own bore in the refining surface of the sensor disk and has a tip that is disposed no higher than the height of the axial surface of an adjacent refiner bar, such as the refiner bar that is next to the sensor. The tip of the sensor is disposed slightly below the axial refiner bar surface to prevent the tip from being physically located in the refining zone while still accommodating bar wear. In one preferred embodiment, the tip is located at least about 0.050 inch (1.3 mm) below the axial bar surface. In another preferred embodiment, the tip is located at least about 0.100 inch (2.5 mm) below axial bar height.

Each sensor preferably is disposed in a bar or groove of the refining surface. Each sensor includes a spacer that spaces a sensing element of the sensor from the surrounding material of the sensor refiner disk. The sensing element is carried by a sensor housing that is carried by the spacer. The sensor housing extends outwardly from the spacer and has its tip located flush with or below the axial refiner bar surface. The sensing element or at least one end of the sensing element can be spaced from an axial end or edge of the spacer.

In a preferred embodiment, the spacer is disposed in a bore in the refining surface. The spacer is tubular and configured to telescopically receive at least a portion of the sensor housing, which can protrude outwardly from the spacer.

At least where the sensor is a temperature sensor, the sensor housing and spacer enclose the sensing element. The housing is comprised of a thermally conductive material and at least part of the housing is immersed in the stock during refiner operation. The spacer is made of a thermally insulating material that thermally insulates the sensing element from the thermal mass of the sensor refiner disk. The sensing element preferably is disposed between the tip of the sensor housing and the spacer. The housing preferably protrudes from the insulating spacer to space the sensing element or the end of the sensing element from the spacer to minimize the impact of the insulating spacer on measurement of a temperature in the refining zone.

Where the sensor is a temperature sensor, the temperature sensor can be used to obtain an absolute measurement of temperature in the refining zone adjacent the sensor. Where a temperature sensor is used to obtain an absolute temperature measurement, the sensing element preferably is of a type that is capable of being calibrated so as to provide measurement repeatability. In one preferred embodiment, the sensing element is an RTD, preferably a three wire platinum RTD.

In another embodiment, the sensor is embedded in a plate set in a pocket in the refining surface of a refiner disk. The spacer is disposed in the bar and carries the sensor or is an integral part of the sensor. The spacer spaces the sensor, including its sensing element, from the surrounding material of the bar and the surrounding material of the refiner disk in which the bar is received. Where the sensor is a temperature sensor, the spacer preferably insulates the sensing element from the thermal mass of the surrounding material.

In one preferred refiner sensor disk embodiment, the sensor disk has a plurality of spaced apart bores in its refining surface that each receives a sensor. Each bore communicates with a wiring passage leading to the backside of the refiner disk. Each of the sensors can be carried by a fixture that is received in a pocket in the backside of the disk. In another embodiment, no fixture is used. In either embodiment, a bonding agent, such as a high temperature potting compound or an epoxy, can be used to seal and anchor the fixture, the wiring, and the sensors to prevent steam and material in the refining zone from leaking from the refining zone.

The sensors of a sensor refiner disk can be linked to a signal conditioner in the vicinity of the refiner in which the disk is installed and can be mounted on the refiner. Each sensor is ultimately linked to a processing device that processes sensor signals into measurements. The processing device is linked to at least one module that holds calibration data or calibration information about one or more sensors of the sensor refiner disk. Preferably, the module holds calibration data or information about each sensor of the sensor refiner disk in an on board memory storage device.

The calibration module is received in a connector box that is linked to the processing device. The module has a connector that removably mates with a complementary connector or socket on board the connector box that is connected to a communications port. The connector box preferably has a plurality of module connectors so that calibration modules for a plurality of sensor disks can be plugged in. The connector box enables sensor calibration data of sensors in sensor disks installed in different refiners to be read and used.

In a method of assembly, one or more bores are formed in the refining surface of a refiner disk or a refiner disk segment. One or more sensors are selected and calibrated before or after being installed in the finished sensor refiner disk or sensor disk segment. The calibration data is stored on a calibration module that is packaged and shipped with the sensor disk or segment to a fiber processing plant having a refiner where the sensor disk or segment is to be installed.

Where one or more of the sensors are temperature sensors and the sensor output will be used to obtain an absolute temperature measurement, a pair of calibration variables preferably is stored for each such temperature sensor. Where a pair of calibration variables is used, one variable preferably provides an offset or an adjustment to the slope of an ideal temperature sensor for the type of sensor used and the other variable preferably provides an intercept offset or intercept adjustment.

When the sensor disk or segment and its calibration module arrives at the fiber processing plant, the sensor disk or segment is installed in one of the refiners linked to the processing device and its module is connected to the device. Where more than one sensor disks or segments are linked to the processing device, the module can be plugged into a socket of a connector box that is associated with the refiner in which the sensor disks or segments have been installed. In another preferred embodiment, the module is plugged into any free socket and it is linked by software to the proper refiner. The module can be configured with a unique digital address that is used to assign it to the proper refiner.

In a method of operation, the output is read from each sensor of the installed refiner disk or segment. Where a signal conditioner is used, the output read by the processing device is a signal from the signal conditioner. The processing device calculates a measurement from the output or signal from each sensor. The measurement is corrected through application of the calibration data or calibration information for the sensor read. If desired, the calibration data is read upon startup of the processing device. It may also be read each time a corrected measurement calculation is made.

Where the sensor is a temperature sensor and an absolute temperature measurement is to be obtained, the signal or output from the temperature sensor is read and its magnitude determined. The magnitude is inputted into an equation that multiplies it by a slope value. The slope value is a corrected slope value that is the result of the slope of an ideal temperature sensor plus or minus a slope calibration offset from the calibration module. An intercept value is added to the result. The intercept value is a corrected intercept value that is the result of the intercept of an ideal temperature sensor plus or minus an intercept calibration offset from the calibration module.

When the sensor disk or segment becomes worn or spent, it is removed and another sensor disk or segment is installed. The calibration module for the spent disk is removed and the calibration module that was shipped with the new disk is installed.

In a broader context, one or more sensors can be carried by a removable sensor module, such as a segment of a refiner disk, that is connected to the processing device linked to at least one calibration module containing calibration data for each sensor of the sensor module.

Objects, features, and advantages of the present invention include at least one of the following: a sensor that is capable of sensing a parameter or characteristic of conditions in the refining zone; that is robust as it is capable of withstanding severe vibration, heat, pressure and chemicals; is capable of repeatable, accurate absolute measurement of the refining zone characteristic or parameter; is simple, flexible, reliable, and long lasting, and which is of economical manufacture and is easy to assemble, install, and use.

Other objects, features, and advantages of the present invention include at least one of the following: a sensor disk or segment that has a plurality of sensors in its refining zone such that refining intensity, flow, and quality are maintained; embeds sensors in the grooves and bars of the refining surface where they are protected yet advantageously capable of accurately sensing the desired refining zone parameter or characteristic; is formed using a minimum of machining steps, time and components; can be formed from any disk or segment having any refiner surface pattern; is capable of being used in a refiner with a minimum modification of the refiner; and is simple, flexible, reliable, and robust, and which is of economical manufacture and is easy to assemble, install, and use.

Additional objects, features, and advantages of the present invention include at least one of the following: a sensor measurement correction system and method that is capable of correcting sensor measurements of a sensor refiner disk with calibration data prestored on a calibration module associated with the sensors of that disk or segment; improves measurement accuracy; improves measurement repeatability; enables an absolute measurement to be determined; is advantageously adaptable to refiner process control schemes; is simple, flexible, reliable, and robust, and which is of economical manufacture and is easy to assemble, install, configure and use.

Other objects, features, and advantages of the present invention will become apparent to those skilled in the art from the detailed description and the accompanying drawings. It should be understood, however, that the detailed description and accompanying drawings, while indicating at least one preferred embodiment of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout and in which:

FIG. 12 is a table of calibration constants;

FIG. 13 is a table of calibration constants for temperatures sensors; and

DETAILED DESCRIPTION OF THE INVENTION

Figure 1:
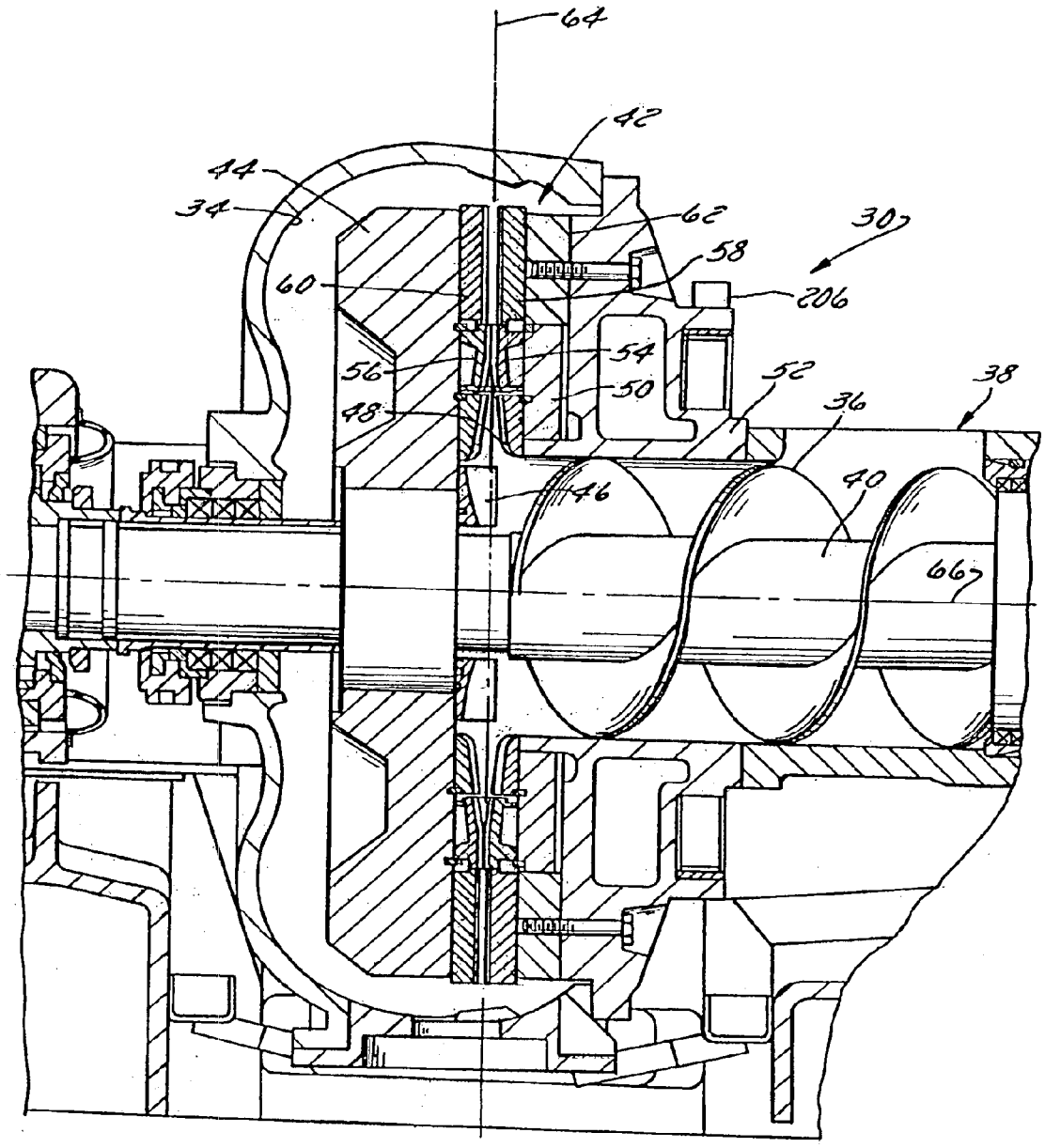
FIG. 1 is a fragmentary cross sectional view of a disk refiner equipped with a sensor refiner disk or disk segment.
Figure 2:
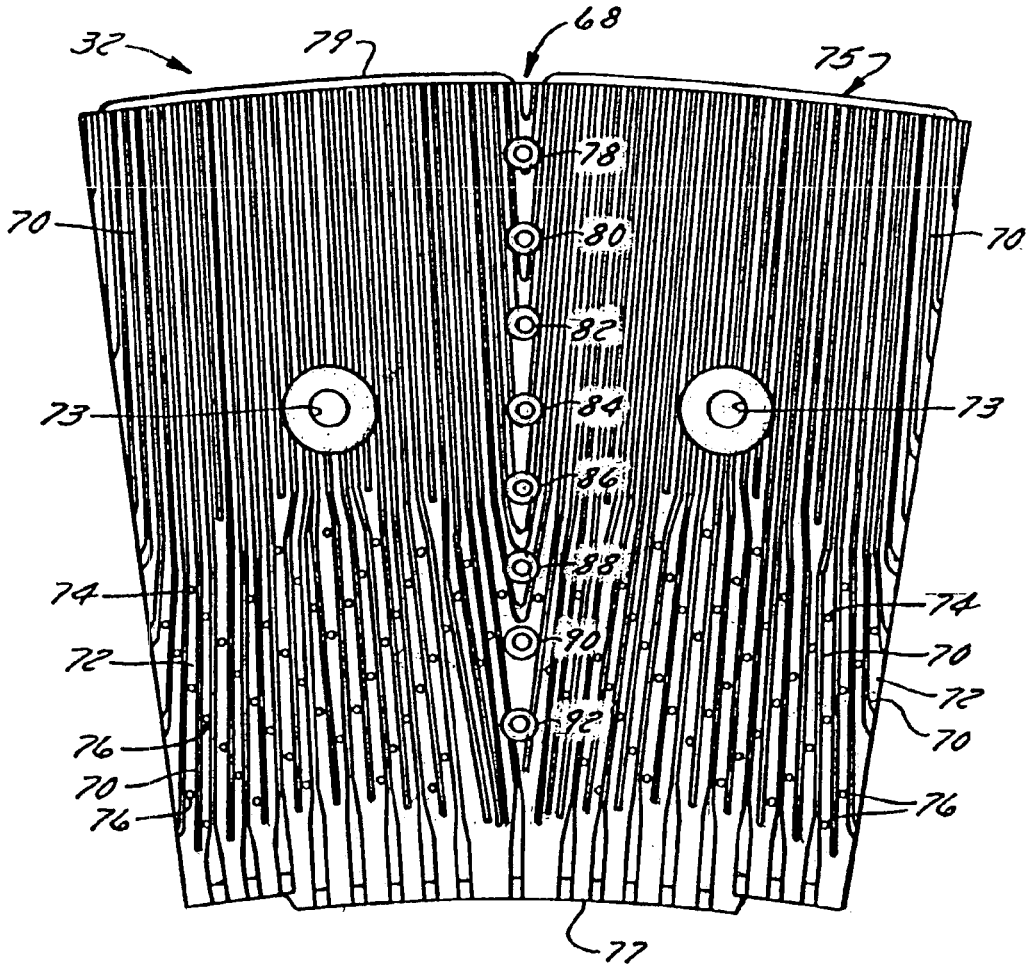
FIG. 2 is a front plan view of a sensor refiner disk segment.
Figure 3:
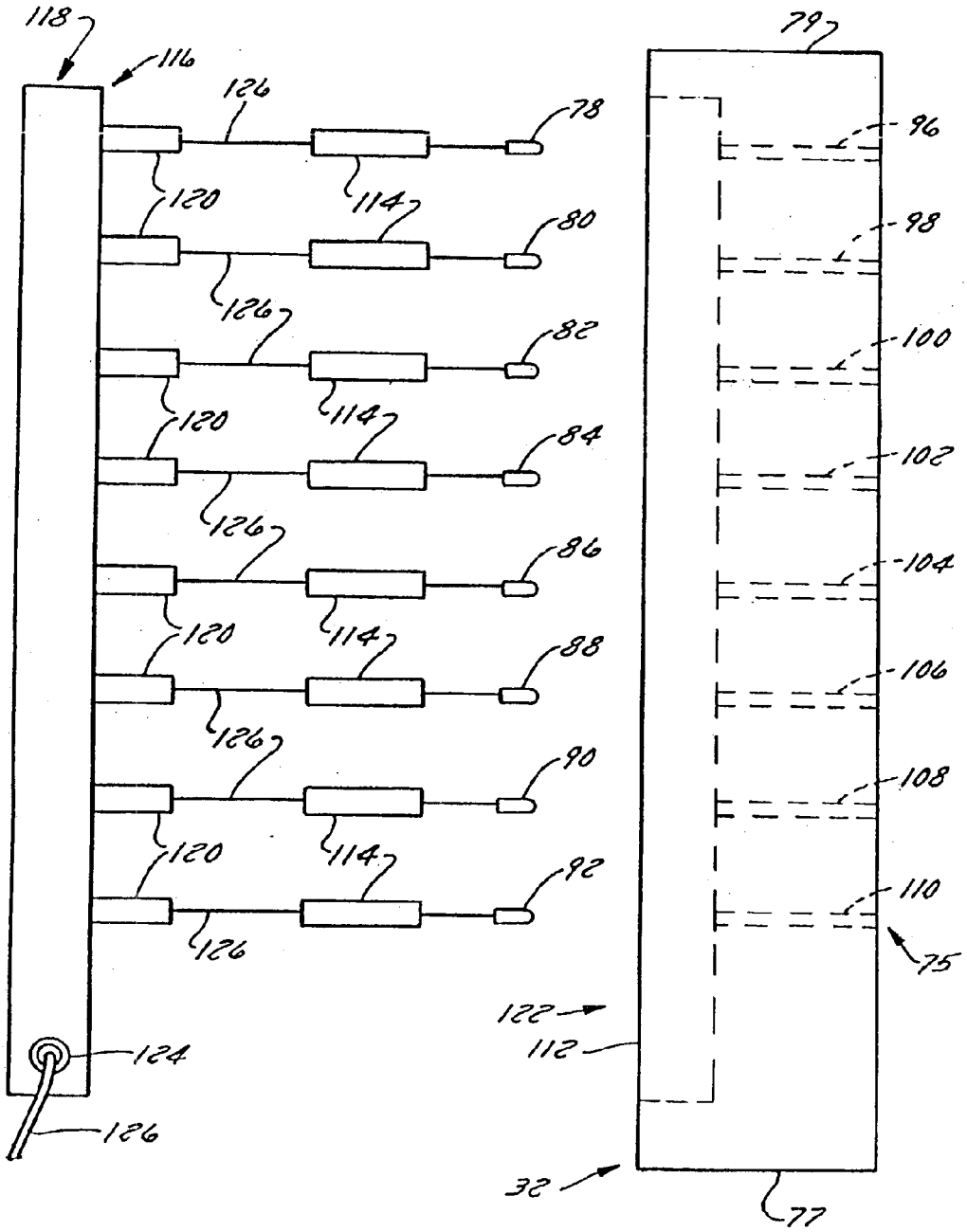
FIG. 3 is an exploded side view of a preferred embodiment of a sensor assembly and sensor refiner disk segment.

FIGS. 1–3 illustrate a refiner 30 to which the invention is applicable. The refiner 30 can be a refiner of the type used in thermomechanical pulping, refiner-mechanical pulping, chemithermomechanical pulping, or another type of pulping or fiber processing application. The refiner 30 can be a counter rotating refiner, a double disk or twin refiner, or a conical disk refiner known in the industry as a CD refiner.

The refiner 30 has a refiner disk or refiner disk segment 32 (FIG. 2) carrying at least one sensor for sensing a parameter in the refining zone during refiner operation. The refiner 30 has a housing or casing 34 and an auger 36 mounted therein which urges a stock slurry of liquid and fiber introduced through a stock inlet 38 into the refiner 30. The auger 36 is carried by a shaft 40 that rotates during refiner operation to help supply stock to an arrangement of treating structure 42 within the housing 34 and a rotor 44. An annular flinger nut 46 is generally in line with the auger 36 and directs the stock radially outwardly to a plurality of opposed sets of breaker bar segments, both of which are indicated by reference numeral 48.

Each set of breaker bar segments 48 preferably is in the form of sectors of an annulus, which together form an encircling section of breaker bars. One set of breaker bar segments 48 is fixed to the rotor 44. The other set of breaker bar segments 48 is fixed to another portion of the refiner 30, such as a stationary mounting surface 50, e.g. a stator, of the refiner or another rotor (not shown). The stationary mounting surface 50 can comprise a stationary part of the refiner frame 52.

Stock flows radially outwardly from the breaker bar segments 48 to a radially outwardly positioned set of refiner disks 54 and 56. This set of refiner disks 54 and 56 preferably is removably mounted to a mounting surface. For example, one disk 56 is mounted to the rotor 44 and disk 54 is mounted to mounting surface 50. The refiner 30 preferably includes a second set of refiner disks 58 and 60 positioned radially outwardly of the first set of disks 54 and 56. Disk 60 is mounted to the rotor 44, and disk 58 is mounted to a mounting surface 62 that preferably is stationary. These disks 58 and 60 preferably are also removably mounted. Each pair of disks 54, 56 and 58, 60 of each set is spaced apart so as to define a small gap between them that typically is between about 0.005 inches (0.127 mm) and about 0.125 inches (3.175 mm). Each disk can be of unitary construction or can be comprised of a plurality of segments.

The first set of refiner disks 54 and 56 is disposed generally parallel to a radially extending plane 64 that typically is generally perpendicular to an axis 66 of rotation of the auger 36. The second set of refiner disks 58 and 60 can also be disposed generally parallel to this same plane 64 in the exemplary manner shown in FIG. 1. This plane 64 passes through the refiner gap between each pair of opposed refiner disks. This plane 64 also passes through the space between the disks that defines the refining zone between them. Depending on the configuration and type of refiner, different sets of refiner disks can be oriented with their refining zones in different planes.

During operation, the rotor 44 and refiner disks 56 and 60 rotate about axis 66 causing relative rotation between the disks 56 and 60 and disks 58 and 62. Typically, the rotor 44 is rotated between about 400 and about 3,000 revolutions per minute. During operation, fiber in the stock slurry is fibrillated as it passes between the disks 54, 56, 58 and 60 refining the fiber.

FIG. 2 depicts a sensor disk segment 32 of a refiner disk, such as disk 54, 56, 58 or 60, which has a sensor assembly 68 disposed in its refining surface. Where the refiner disks of a particular refiner are not segmented, the sensor assembly 68 is disposed in a portion of one of the refiner disks. The sensor disk segment 32 has a plurality of pairs of spaced apart-upraised refiner bars 70 that define refiner grooves or channels 72 therebetween. The segment 32 preferably is made of a wear resistant machinable material, such as a metal, an alloy, or a ceramic. The bars 70 and grooves 72 define a refining surface 75 that generally extends from an inner diameter 77 to an outer diameter 79 of the segment. The pattern of bars 70 and grooves 72 shown in FIG. 2 is an exemplary pattern, as any pattern of bars 70 and grooves 72 can be used. If desired, surface 74 or subsurface dams 76 can be disposed in one or more of the grooves 72. The segment 32 can have one or more mounting bores 73 for receiving a fastener, such as a bolt, a screw, or the like.

During refining, fiber in the stock that is introduced between opposed refiner disks is refined by being ground, abraded, or mashed between opposed bars 70 of the disks, thereby fibrillating the fibers. Stock in the grooves 72 and elsewhere in the refining zone between the disks flows radially outwardly and can be urged in an axial direction by dams to further encourage refining of the fiber. Depending on the construction, arrangement, and pattern of the bars 70 and grooves 72, differences in angle between the bars 70 of opposed disks due to relative movement between the disks can repeatedly occur during operation. Where and when such differences in angle occur, radial outward flow of stock between the opposed disks is accelerated, pumping the stock radially outwardly. Where and when the bars 70 and grooves 72 of the opposed disks are generally aligned, flow is retarded or held back.

The sensor assembly 68 includes one or more sensors and preferably includes a plurality of spaced apart sensors 78, 80, 82, 84, 86, 88, 90, and 92. If desired, the sensor assembly 68 can be comprised of at least three sensors, at least four sensors, at least five sensors and can have more than eight sensors. In the preferred embodiment shown in FIG. 2, eight sensors 78, 80, 82, 84, 86, 88, 90, and 92 are disposed generally along a radial line and are equidistantly spaced apart. For example, in one preferred embodiment each pair of adjacent sensors is spaced apart from their centers about ⅞ of an inch (approximately 22 millimeters).

Even if not disposed in a radial line, the sensors preferably are located at different radiuses along the segment such that they are radially spaced apart. Having sensors radially spaced apart provides a distribution of measurements along the length of the refining zone. Such a distribution of measurements advantageously enables an average measurement to be determined, slopes and derivatives to be calculated, and other calculations on the measurement distribution to be performed.

Referring additionally to FIG. 3, each sensor 78, 80, 82, 84, 86, 88, 90, and 92 (shown in phantom) is respectively disposed in a bore 96, 98, 100, 102, 104, 106, 108, and 110 in the refining surface 75 of the disk or disk segment. In the preferred embodiment shown in FIG. 3, each bore 96, 98, 100, 102, 104, 106, 108, and 110 is a hole of round cross section that extends completely through the segment 32. If desired, each bore 96, 98, 100, 102, 104, 106, 108, and 110 can extend from the refining surface 75 toward the rear surface 112 of the segment 32 a sufficient depth to receive a sensor. Where each bore 96, 98, 100, 102, 104, 106, 108, and 110 does not extend completely through the segment 32, the bores communicate with one or more wiring passages so that sensor wiring can be routed to the rear of the segment 32.

Still referring to FIG. 3, each sensor is received in a spacer 114. The spacer 114 spaces the sensor from the surrounding refiner disk material and can insulate the sensor to prevent the thermal mass of the segment from interfering with sensing the desired parameter or parameters in the refining zone. The spacer 114 preferably also dampens refiner disk vibration by helping to isolate the sensor from normal refiner vibration as well as the kind of shock that can occur when opposed refiner disks come into contact with each other and clash. In one preferred embodiment, the spacer 114 is affixed to the sensor disk segment 32 by an adhesive 115 (FIG. 5), such as a high temperature potting compound, an epoxy or the like.

Because of the types of alloys used and the construction of the bars 70 and grooves 72 of a refiner disk or segment, the bores 96, 98, 100, 102, 104, 106, 108, and 110 preferably are produced using an electric discharge machining (EDM) method or the like. EDM machining advantageously permits forming each sensor-receiving bore in the refining surface such that there is a minimum of loss of refining surface area. If desired, each bore can be cast into the refining surface.

FIG. 3 also depicts a fixture 116 in the form of hollow conduit 118 that resembles a manifold and that can have a holder 120 for each sensor. The conduit 118 preferably is of square cross section but can have other cross sectional shapes. The fixture 116 is received in a pocket 122 (shown in phantom) in the backside of the segment 32. The fixture 116 has an opening 124 at one end through which sensor wiring 126 exits the fixture 116.

Where sensor holders 120 are used, each sensor holder 120 preferably is tubular and telescopically receives and retains at least part of a spacer 114. In another preferred embodiment, no sensor holders 120 are used. Instead, a sensor-receiving bore is formed in the fixture 116 in place of each holder 120. The spacer 114 of each sensor is disposed in one of the bores in the fixture 116.

In assembly, each sensor and spacer 114 is received in the fixture 116 and the fixture 116 is inserted into the refiner backside pocket 122 with each holder 120 disposed at least partially in one of the sensor-receiving bores. High temperature potting compound preferably is placed around the fixture 116 to help anchor it to the segment 32 and to help prevent steam and stock from escaping from the refining zone. If desired, potting compound or another high temperature, hardenable material can be placed in the pocket 122 to seal and anchor the fixture 116 before inserting the fixture 116 into the pocket 122. The conduit 118 preferably is also filled with a thermally protective sealing material, such as silicone, potting compound, or the like.

Figure 4:
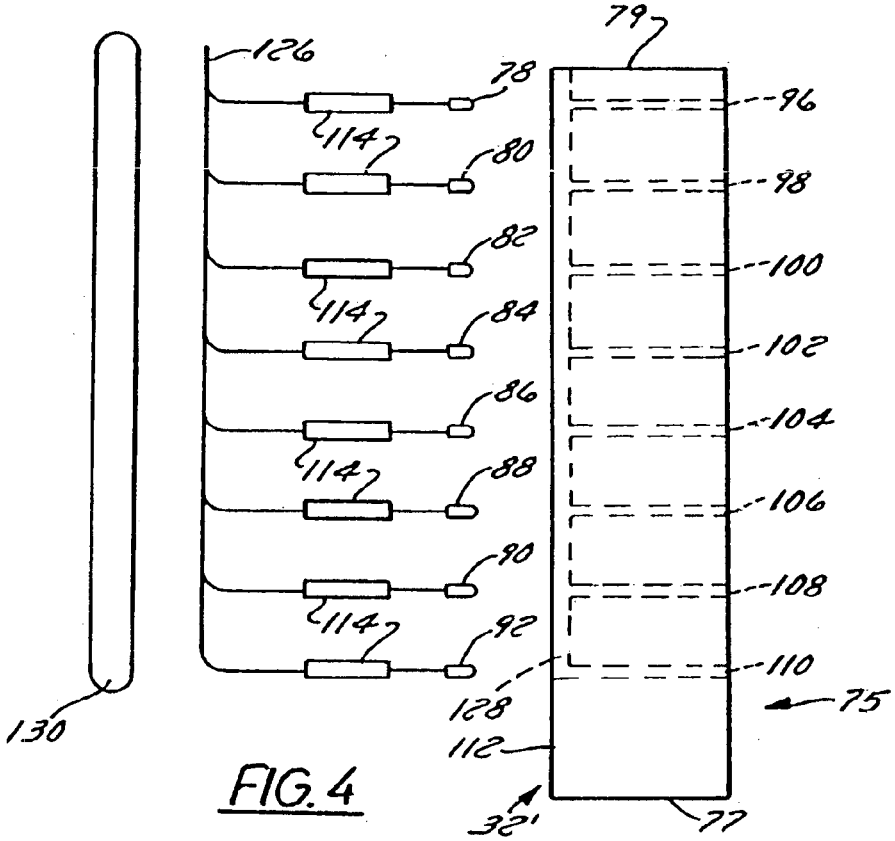
FIG. 4 is an exploded side view of a second preferred embodiment of a sensor assembly and sensor refiner disk segment.

FIG. 4 illustrates another preferred arrangement where no fixture is used in the sensor disk segment 32'. In assembly, each sensor is carried by a spacer 114. Each spacer 114 is disposed in one of the bores. If desired, the backside of the sensor disk segment 32' (or a one-piece refiner disk where the disk is not segmented) can have a wire-receiving channel 128. Preferably, the channel 128 connects each bore 96, 98, 100, 102, 104, 106, 108 and 110. Potting compound 130 is applied to the disk or segment backside over and preferably into each bore (from the backside). Where the segment 32' has a wire-receiving channel 128, potting compound 130 or another high temperature material is also placed in the channel 128 around the sensor wires 126 to hold them in place and protect them.

Each sensor disk segment 32 (or 32') is removably mounted to a stator of the refiner 30, such as stationary mounting surface 50 or 62. The sensor wiring 126 passes through a bore (not shown) in the mounting surface 50 or 62 and a bore (not shown) in the refiner housing 34 or frame 52 to the exterior of the refiner 30. Where a signal conditioner 206 is used, it is mounted to the refiner housing 34 or frame 52, such as in the manner depicted in FIG. 1, and connected to the sensor wiring 126. Each bore through which sensor wiring 126 passes preferably is sealed, such as with a high temperature epoxy, potting compound or another material. If desired, the wiring 126 can be received in a protective conduit. To facilitate assembly and removal, the wiring can include a connector (not shown) inside the refiner 30 adjacent the sensor disk segment 32 that minimizes the length of wiring each sensor disk segment needs. Where the sensor disk segment 32 (or 32') is installed on a rotor 44, the wiring 126 can be connected to a slip ring (not shown) or telemetry can be used to transmit the sensor signals.

Figure 5:
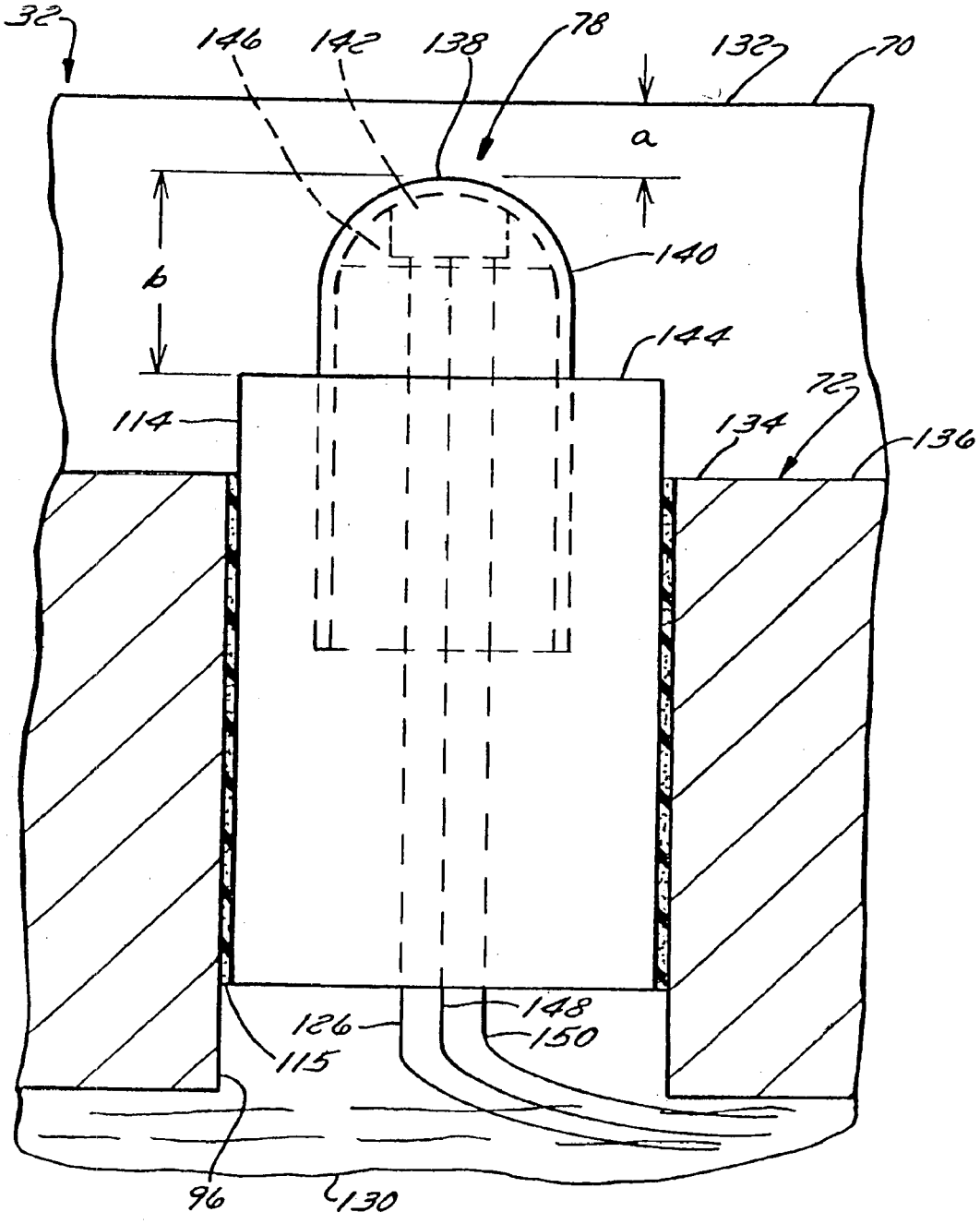
FIG. 5 is an enlarged partial fragment cross sectional view of a sensor disposed in a bore in the sensor refiner disk segment.

FIG. 5 illustrates a single sensor, sensor 78 for example, embedded at least partially in a sensor disk segment 32. The tip of the sensor 78 preferably is located between an axial outer surface 132 of an adjacent refiner bar 70 and a floor 134 of the segment 32. In FIG. 3, the floor 134 is the bottom surface 136 of an adjacent groove 72, e.g. the groove next to the sensor 78 or in which it is disposed. If desired, such as where it is desirable to minimize turbulence or other phenomena from affecting sensor operation, the floor around the sensor 78 can be a well, such as a countersink, a counterbore, or the like, that is set below the surface 136 of the adjacent groove 72. For example, such a floor 134 can be a machined or cast depression or the like. When located in a groove 72, the sensor 78 and spacer 114 advantageously collectively functions as a surface or subsurface dam to urge radially flowing stock up and over the sensor 78 to help encourage refining.

The tip 138 of the sensor 78 is located flush with or below the axial outer surface 132 of an adjacent bar 70 to prevent the sensor 78 from being damaged during refiner operation. For example, by locating the tip of the sensor 78 below surface 132 of adjacent bar 70, it helps prevent matter in the stock slurry from forcefully impinging against and damaging the sensor 78. Additionally, it prevents refiner disk clashing from damaging the sensor 78.

In the preferred embodiment shown in FIG. 5, the tip 138 of the sensor 78 preferably is offset a distance, a, below the axial outer bar surface 132 of an adjacent bar 70 so that it does not end up protruding into the refining zone when the axial height of the bar 70 decreases as a result of wear. Depending on the type of refiner, the type of refining being performed, the refiner disk alloy or alloys used, and other factors, the magnitude of the offset, a, selected can vary. Preferably, the offset, a, is at least 0.050 inch (1.27 mm) below the axial bar surface 132 when the segment 32 is new, e.g., the tip 138 of the sensor 78 is located at least 0.050 inch below the axial bar surface 132 when the segment 32 is in a new or unused condition. In another preferred embodiment, the offset, a, is 0.100 inch (2.54 mm) or greater.

The sensor 78 preferably includes a tubular housing 140 that is carried by the spacer 114. A sensing element 142, shown in phantom in FIG. 3, is carried by the housing 140. The housing 140 preferably protects the sensing element 142. The housing 140 protrudes from the spacer 114 to space the end of the sensing element 142 (adjacent tip 138) from the spacer 114 such that the spacer 114 does not shield the sensing element 142 too much and interfere with its operation.

As is shown in FIG. 5, a second offset between the tip 138 of the housing 140 and the end 144 of the spacer 114 is indicated by reference character b. In one preferred embodiment, the tip 138 of the housing 140 has an offset, b, of at least 1/16 inch (1.6 mm) such that the axial end of least about 1/32 inch (0.8 mm) from the end 144 of the spacer 114. In another preferred embodiment, the tip 138 of the housing 140 has an offset, b, of at least 1/8 inch (3.2 mm) such that the end of the sensing element 142 is spaced at least about 1/16 inch (1.6 mm) from the end 144 of the spacer 114.

In the latter case, as is shown in FIG. 5, the entire sensing element 142 is spaced from the end 144 of the spacer 114. Where the housing 140 has a rounded or a rounded and enclosed end, the tip of the housing 140 can be spaced from the end 144 of the spacer 114 a distance at least as great as the radius of curvature of the rounded end to help ensure that the entire sensing element 142 or enough of the sensing element 142 is not shielded by the spacer 114.

The sensing element 142 preferably is a temperature-sensing element, such as an RTD, a thermocouple or a thermistor. Where it is desired to measure the absolute temperature of the stock slurry in the refining zone, one preferred sensing element 142 is an RTD that preferably is a platinum RTD. Where greater temperature measurement accuracy is desired, an RTD sensing element 142 also is preferred. This is because an RTD sensing element is a relatively accurate device, advantageously can be accurately calibrated, and can be used with rather compact signal conditioning devices that can transmit conditioned temperature measurement signals relatively long distances, typically in excess of 4000 feet (1219 m), to a remotely located processing device.

As is shown in FIG. 5, the temperature sensing element 142 is disposed inside the housing and is affixed to an interior wall of the housing 140 using an adhesive 146 (shown in phantom), such as a high temperature epoxy, a potting compound, or the like. In the preferred embodiment depicted in FIG. 5, the sensing element 142 has at least one wire 126 and preferably has a pair of wires 126 and 148. Where an RTD sensing element is used, the sensing element 142 can have a third wire 150 to prevent the electrical resistance of the wires 126 and 148 from impacting temperature measurement. If desired, a four wire RTD temperature sensing element can also be used.

The housing 140 functions to protect the temperature-sensing element 142 but yet permit heat to be conducted to the element 142. In a preferred embodiment, the housing 140 is made of a stainless steel that has a thickness of about one millimeter for providing a response time at least as fast as 0.5 seconds where an RTD temperature-sensing element 142 is used. For example, a platinum RTD temperature-sensing element 142 has a response time of about 0.3 seconds when a one millimeter thick stainless steel housing 140 is used.

As is shown in FIG. 5, at least part of the housing 140 is telescopically received in the spacer 114 and preferably is affixed to it by an adhesive, such as a high temperature epoxy, a potting compound, or the like. The spacer 114 is telescopically received in a bore 96 and affixed to the interior sidewall of the bore 96 by an adhesive 115, such as a high temperature epoxy, a potting compound, or the like.

Figure 6:
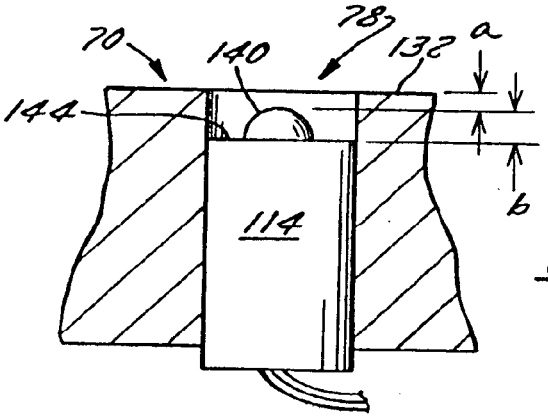
FIG. 6 is a partial fragment cross sectional view of a sensor disposed in a bore in a refiner bar of the sensor refiner disk segment.
Figure 7:
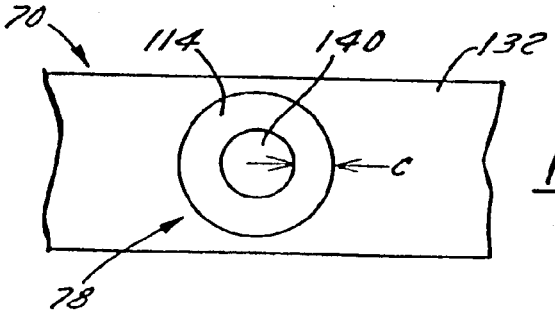
FIG. 7 is a top plan view of the sensor and refiner bar.

FIGS. 6 and 7 depict a sensor 78 embedded in a refiner bar 70. Depending on the width of the bar 70, the entire sensor 78 can be embedded in the bar 70 or only a part of the sensor 78 can be embedded. FIG. 7 more clearly shows the spacer 114 encircling the sensor housing 140.

The wall thickness, c, of the spacer 114 preferably is at least about 1/64 inch (about 0.4 mm). In one preferred embodiment, the spacer 114 has a wall thickness of about 1/16 inch (about 1.6 mm). The spacer 114 preferably is of tubular or elongate and generally cylindrical construction.

As a result of using a spacer and sensor that is small, preferably no wider than about 3/8 inch (9.5 mm), the width or diameter of each sensor-receiving bore in the segment 32 also preferably is no greater than about 7/16 inch (11.1 mm). As a result, the percentage of surface area of all of the bore openings is very small. By locating the array of sensors 78, 80, 82, 84, 86, 88, 90, and 92 within the pattern of refiner bars 70 and grooves 72 and by keeping each sensor small relative to the total area of the refining surface, pulp quality is not affected by use of the sensors. Because the sensors are located in the refiner bars and groove, shives and other objects cannot follow sensors and bypass being refined because each sensor is surrounded about its periphery by refining surface. In one preferred embodiment, each spacer and sensor is no wider than about 1/4 inch (6.4 mm) and the width or diameter of the bore in the segment 32 is no greater than about 5/16 inch (7.9 mm).

In a preferred embodiment, the spacer 114 also is an insulator that insulates the sensing element 142 from the thermal mass of the surrounding refiner disk. An insulating spacer 114 also helps insulate the sensing element 142 from thermal transients caused by refiner disks clashing during operation. Preferably, at least where the sensing element 142 is a temperature sensing element, the insulating spacer 114 spaces the sensor from the sensor disk segment 32 at least about 1/32 inch (about 0.8 mm). Preferably, the insulating spacer 114 is made of a material and has a thickness that provides an R-value of at least about $5.51*10^{-3}$ h*ft*° F./Btu to ensure that the sensing element 142 is sufficiently insulated from the thermal mass of the surrounding material.

An example of a suitable insulating spacer is a generally cylindrical tube made of a ceramic material, such as alumina or mullite. Other examples of suitable insulating materials include an aramid fiber, such as KEVLAR, or a tough thermoplastic capable of withstanding temperatures at least as great as 428° F. (220° C.) and the severe environment found inside the refining zone. For example, a suitable insulating spacer material should be capable withstanding refiner disk vibration and thermal cycling, be chemically inert, be able to withstand moisture, and be abrasion resistant.

Where the sensing element 142 is a temperature-sensing element, the spacer 114 is an insulating spacer. One preferred insulating spacer 114 is an OMEGATITE 200 model ORM cylindrical thermocouple insulator commercially available from Omega Engineering, Inc., One Omega Drive, Stamford, Conn. This insulating spacer 114 is comprised of about 80% mullite and the remainder glass. One preferred insulating spacer 114 is a model ORM-1814 thermocouple insulator. This insulating spacer 114 has an outer diameter of 1/4 inch (about 6.4 mm), an inner diameter of 1/8 inch (about 3.2 mm), and a wall thickness of about 1/16 inch (about 1.6 mm). Such an insulating spacer 114 accommodates a sensor 78 having housing that is about 1/8 inch (3.2 mm) in diameter or smaller.

Where the sensing element 142 is a temperature-sensing element, the end or tip of the housing 140 preferably completely encloses the sensing element 142 to protect it. For another type of sensing element, such as a pressure-sensing element, the end or tip of the housing 140 can be open to permit stock from the refining zone to directly contact the sensing element.

The combination of a platinum RTD temperature sensor 78 and insulating spacer 114 provides a robust sensor assembly that is advantageously capable of withstanding the rather extreme conditions in the refining zone for at least the life of the sensor disk segment 32, if not longer. For example, the combination of a one millimeter thick stainless steel housing 140, platinum RTD sensing element 142, and ceramic insulating spacer 114 produces a temperature sensor 78 embedded in a refiner disk segment and exposed to the refining zone that can withstand a pressure in the refining zone that can lie anywhere within a range of about 20 psi (1.4 bar) to about 120 psi (8.3 bar), a temperature in the refining zone that can lie anywhere between 284° F. (140° C.) and 428° F. (220° C.), and last at least the life of a typical refiner disk segment, which is at least 800 hours and which typically ranges between 800 hours and 1500 hours.

If desired, one or more sensors 78, 80, 82, 84, 86, 88, 90 and 92 of a sensor refiner disk segment 32 can be a pressure sensor. If desired, each of the sensors 78, 80, 82, 84, 86, 88, 90 and 92 of a sensor refiner disk segment 32 can be a pressure sensor. If desired, a combination of pressure and temperature sensors can be used in a single segment 32. Where one or more pressure sensors are used to sense pressure in the refining zone, a ruggedized pressure transducer, such as one of piezoresistive or diaphragm construction, can be used. An example of a commercially available pressure transducer that can be used is a Kulite XCE-062 series pressure transducer marketed by Kulite Semiconductor Products, Inc. of One Willow Tree Road, Leonia, N.J.

Figure 8:
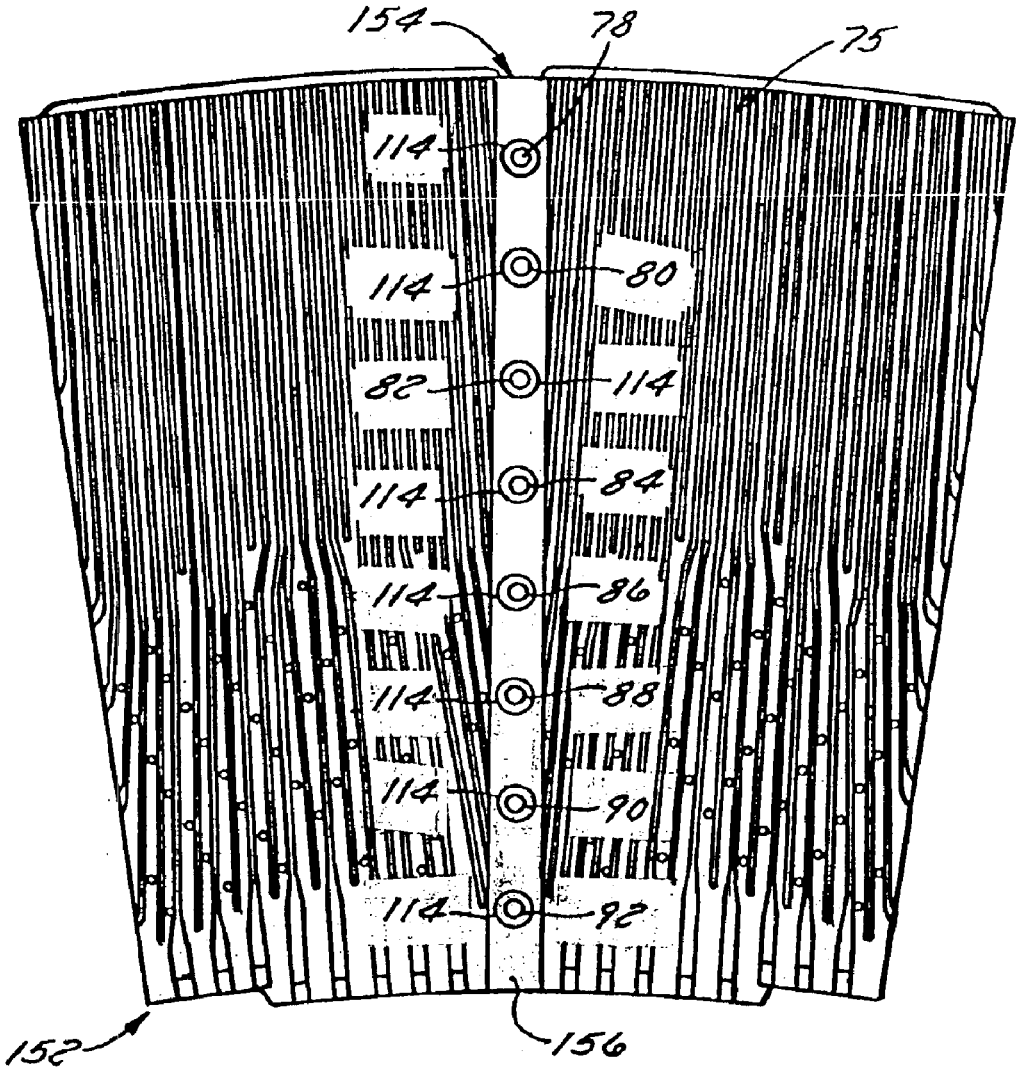
FIG. 8 is a front elevation view of a refiner disk segment that has sensors mounted in a plate.

FIG. 8 illustrates a plurality of the aforementioned sensors 78, 80, 82, 84, 86, 88, 90 and 92 that are each mounted in a plate 156 that is disposed in a refiner disk segment 152. The plate 156 is disposed in a radial channel or pocket machined or cast into the refining surface 75 of the segment 152. The bar or plate 156 can be anchored to the segment 152 by an adhesive, such as a potting compound or an epoxy. If desired, one or more fasteners can be used to anchor the plate 156.

FIGS. 9–14 illustrate a calibration module 160 and a sensor correction system 162 for using calibration data stored on the module 160 to obtain more accurate measurements from the data from one or more of the sensors 78, 80, 82, 84, 88, 90, and 92 of a sensor refiner disk or disk segment. Calibration data for each sensor 78, 80, 82, 84, 88, 90, and 92 is stored on the module 160. By storing sensor calibration data on a module 160 for each sensor, the sensors are precalibrated, the calibration data stored on the module, the sensors assembled to a sensor refiner disk or disk segment, and the sensor refiner disk or segment shipped together with its module 160 to a fiber processing plant for installation into a refiner. The module 160 associated with that particular sensor refiner disk or disk segment is plugged into a socket or port linked to a processing device 164 that is linked to the refiner 32 into which the sensor refiner disk or sensor disk segment is installed.

Figure 9:
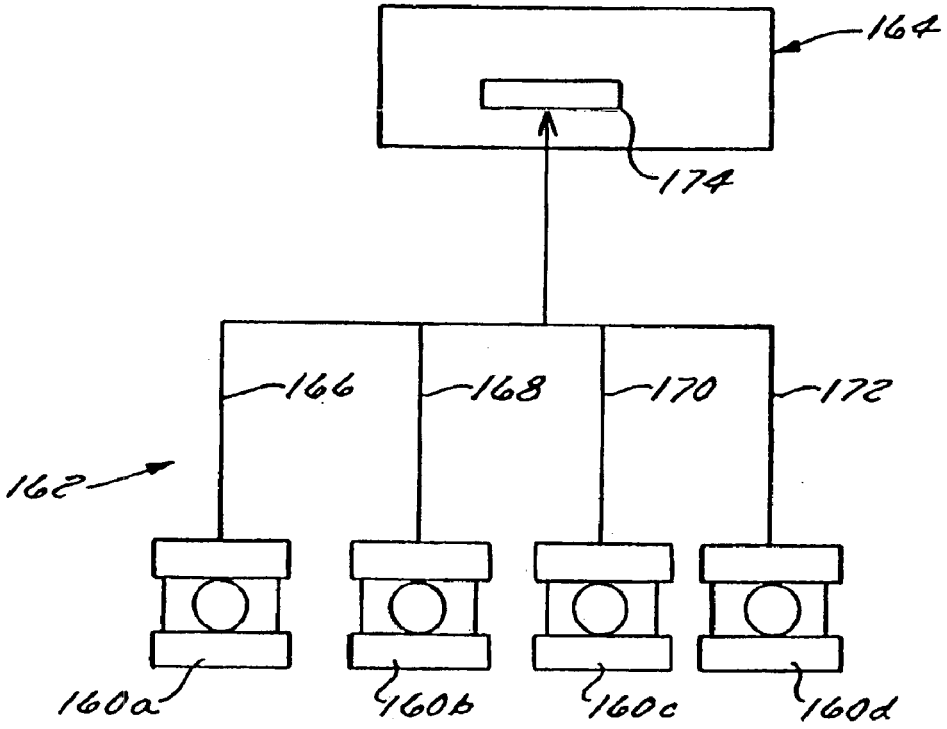
FIG. 9 is a schematic view of a sensor measurement correction system.

FIG. 9 is a schematic depiction of a sensor correction system 162 that has four calibration modules 160*a*, 160*b*, 160*d* and 160*e* connected by links 166, 168, 170 and 172 to a port 174 of the processing device 164. Each of the links 166, 168, 170 and 172 preferably comprise one or more digital data lines that can be connected through the port 174 to a bus of the processing device 164. The processing device 164 has an on-board processor, such as a microcomputer or microprocessor, and preferably comprises a computer, such as a personal computer, a programmable controller, or another type of computer. The processing device 164 may be a dedicated processing device or a computer that also controls some aspect(s) of operation of the refiner 32. An example of such a processing device 164 is a distributed control system computer (DCS) of the type typically found in fiber processing plants, such as paper mills and the like.

Figure 10:
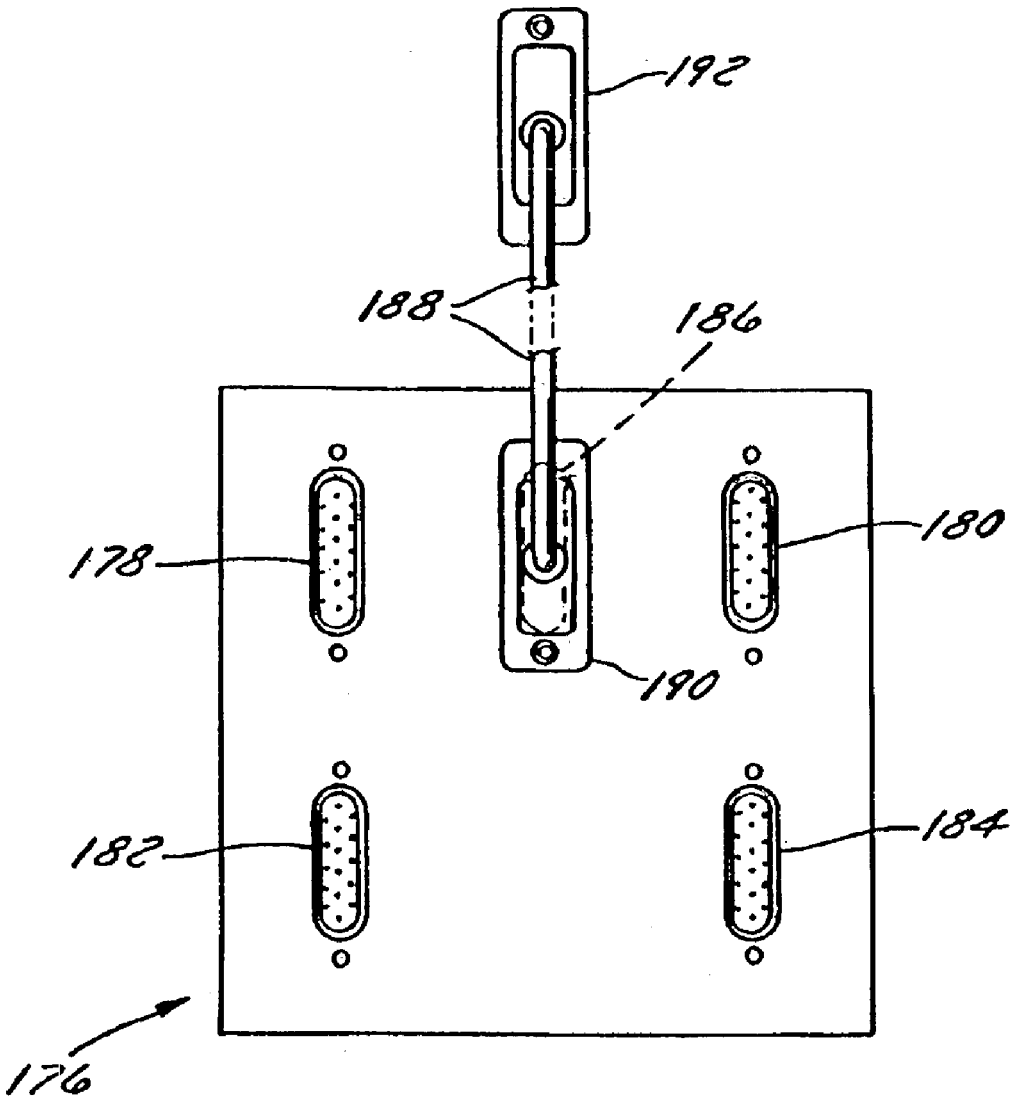
FIG. 10 is a top plan view of a connector box.

FIG. 10 illustrates a module connector box 176 that can be a multiplexing data switch or the like. The module connector box 176 has four sockets or connectors 178, 180, 182, and 184, each for receiving one of the modules 160*a*, 160*b*, 160*c* and 160*d*. The box 176 also has an output socket or connector 186 that preferably accepts a cable 188 that links the modules 160*a*, 160*b*, 160*c*, and 160*d* to the processing device 164 (not shown in FIG. 10). The cable 188 has a connector 190 at one end that is complementary to and mates with connector 186. The cable 188 has a connector 192 at its opposite end that mates with a complementary connector (not shown) of the processing device 164. If desired, the connector box 176 can comprise a card, such as a PCI card, that is inserted into a socket inside the processing device and that has a plurality of ports each linked to one of the modules 160*a*, 160*b*, 160*c* and 160*d*.

Where a cable 188 is used, the cable 188 preferably is a computer cable containing a plurality of wires each capable of separately carrying digital signals. In one preferred embodiment, the cable 188 is a parallel printer cable having one 25-pin connector and a second connector that can have either 25 pins or 36 pins. Such a cable preferably is attached to a parallel port 174 of the processing device 164, such as a printer port that can be bi-directional. The cable 188 can also be configured to attach to other types of ports including, for example, an RS232 port, an USB port, a serial port, an Ethernet port, or another type of port. Other types of connectors can also be used. The same is true for the connectors 178, 180, 182 and 184 on board the connector box 176.

Figure 11:
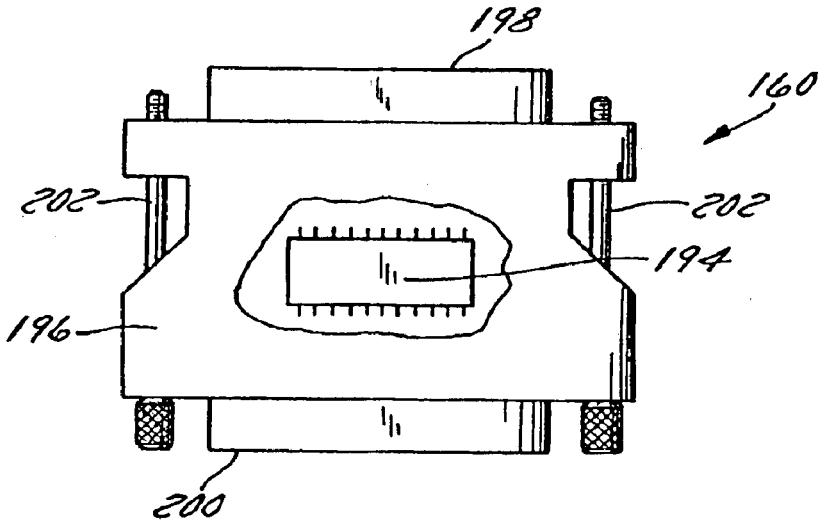
FIG. 11 is a top plan view of a sensor calibration module, cutaway to show a calibration data storage device inside.

FIG. 11 illustrates one preferred embodiment of the calibration module 160. The module 160 has an on board storage device 194 in which the calibration data is stored. The on board storage device 194 is received inside a protective housing 196 of the module 160. The embodiment depicted in FIG. 11 has one multiple pin female connector 198 and one multiple pin male connector 200 permitting pass through of digital signals. This feature advantageously permits other devices to piggyback on or chain to the module 160. The module 160 also has a pair of fasteners 202 to secure the module 160 to one of the connectors 178, 180, 182 or 184 of the connector box 176.

The on board storage device 194 preferably is an application specific integrated circuit (ASIC) chip with on board programmable memory storage. Other suitable onboard storage devices that can be used include an erasable programmable read only memory (EPROM), an electronically erasable programmable read only memory (EEPROM), a programmable read only memory (PROM), a read only memory (ROM), a flash memory, a flash disk, a non-volatile random access memory (NVRAM), or another type of integrated circuit storage device that preferably retains its contents when electrical power is turned off. If desired, a static random access memory (SRAM) chip can be connected to an on board battery to retain the calibration data when electrical power is turned off.

In its preferred embodiment, the plug-in module 160 is small, not more than 2.5 inches by 2.5 inches (63.5 mm by 63.5 mm) in size, and is lightweight, weighing not more than two ounces (0.06 kg). Such a small and lightweight module 160 advantageously makes it easy and inexpensive to ship with the sensor refiner disk segment with which the module is configured to operate. In one preferred embodiment, the module 160 is a HARDLOCK E-Y-E key that is a dongle with two parallel connectors and is commercially available from Aladdin Knowledge Systems of 1094 Johnson Drive, Buffalo, Grove, Ill. Another suitable module 160 is a HARDLOCK USB that is also commercially available from Aladdin Knowledge Systems.

FIG. 12 illustrates a lookup table of calibration constants for the sensors 78, 80, 82, 84, 86, 88, 90 and 92 that are stored in the calibration module 160 for a particular sensor refiner disk. Each sensor has at least one calibration constant that is applied to its output by the processing device 160 to make sensor measurements more accurate. It can be applied through addition, subtraction, multiplication or another mathematical operation.

FIG. 13 illustrates a second lookup table of exemplary calibration constants that preferably are used when the sensing element 142 is a temperature-sensing element, such as an RTD. Each temperature-sensing element 142 provides an output that is substantially linear relative to temperature and can thus be approximated as a line with a slope and intercept:

$$T \approx M^{*}MC+I \qquad \text{(Equation I)}$$

where T is the temperature, M is the slope, MC is the measured characteristic, and I is the intercept. For example, for an RTD sensor the measured characteristic is the resistance of the sensing element that the sensing element outputs during operation. The measured resistance varies generally linearly with temperature. For a thermocouple, the measured characteristic that gets outputted is voltage.

Each temperature sensor can be approximated by an equation of a line that represents a perfectly accurate sensor of the particular sensor type:

$$T \approx M_i^{*}MC+I_i \qquad \text{(Equation II)}$$

where $M_i$ is the slope of the ideal line and $I_i$ is the intercept of the ideal line.

However, each temperature sensor typically deviates somewhat in slope and intercept from an ideal line. To estimate this deviation, each sensor is calibrated by subjecting it to known temperature references, such as ice or ice water and boiling water, and its output at those reference temperatures is read. Other temperature references, such as specific temperatures from a calibration oven or the like can be used to calibrate sensors in their expected operating temperature range.

The equation of a line is then determined from the output data and compared to the ideal line of the perfectly accurate ideal sensor. The difference in slopes provides a first calibration constant, $C_1$, for the particular sensor that will later, during actual sensor operation, be applied to the ideal line equation as a slope offset. The method used to determine the slope offset, $C_1$, is set forth below:

$$C_1=M_i-M \qquad \text{(Equation III)}$$

The difference in intercepts provides a second calibration, $C_2$, constant for the particular sensor that will later, during actual sensor operation, be applied to the ideal line equation as an intercept offset. The method used to determine the intercept offset, $C_2$, is set forth below:

$$C_2=I_t-I \quad \text{(Equation IV)}$$

Therefore, to obtain a more accurate temperature reading from the particular sensor, Equation II above is modified below as follows:

$$T_{corr}=(M_t+C_1)*MC+(I_t+C_2) \quad \text{(Equation V)}$$

where $T_{corr}$ is the corrected temperature reading obtained by applying calibration constants $C_1$ and $C_2$ to the measured characteristic outputted by the sensor.

By storing slope and intercept offset calibration constants on a calibration module 160, the temperature actually measured by each sensor 78, 80, 82, 84, 86, 88, 90 and 92 of a particular sensor refiner disk segment can be corrected to provide an absolute temperature value that is accurate to at least within about ±2.5° F. (±1.5° C.). Where the temperature sensing element is an RTD, preferably a platinum RTD, and calibration is done with ice or ice water and boiling water, the temperature measured by each sensor 78, 80, 82, 84, 86, 88, 90 and 92 can be corrected using such calibration constants to advantageously provide an absolute temperature that is highly repeatable and accurate to at least within about ±0.5° F. (±0.3° C.). Where the temperature sensing element is an RTD, preferably a platinum RTD, and calibration is done using a calibration oven over a temperature range anywhere in between about 212° F. (100° C.) to about 392° F. (200° C.), the temperature measured by each sensor 78, 80, 82, 84, 86, 88, 90 and 92 can be corrected using such calibration constants to advantageously provide an absolute temperature that is highly repeatable and accurate to at least within about ±0.18° F. (±0.1° C.). As a result of using multiple temperature sensors that sense temperature in the refining zone generally along the radius of the disk or disk segment, a profile of the temperature throughout the refining zone can advantageously be obtained and graphically be depicted on a computer display in real time.

Figure 14:
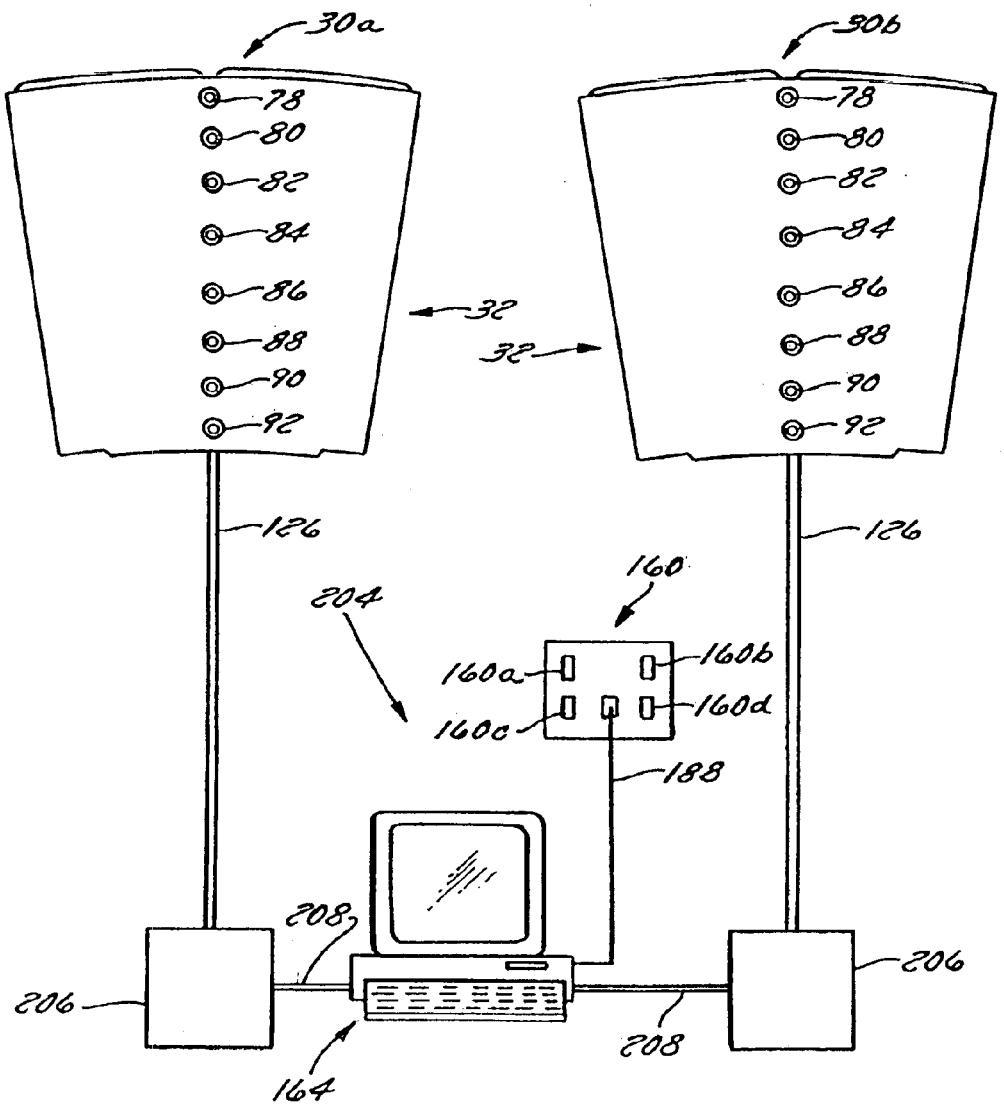
FIG. 14 is a schematic view of a refiner monitoring and control system that uses a sensor measurement correction system and calibration modules capable of providing corrections to measurements from sensors in as many as, for example, four different refiners.

FIG. 14 depicts a refiner monitoring and control system 204. The system 204 includes a pair of sensor refiner disk segments 32 (bars and grooves not shown in FIG. 14 for clarity) each installed in a separate refiner 30*a* and 30*b*. Each segment 32 has a plurality of sensors 78, 80, 82, 84, 86, 88, 90 and 92 embedded in its refining surface. The sensors 78, 80, 82, 84, 86, 88, 90 and 92 are each connected by wiring 126 to a signal conditioner 206. The signal conditioner 206, in turn, is connected by a link 208 that can be a wire, such as is depicted, but can also be a wireless link, such as can be achieved using telemetry or the like.

As is shown in FIG. 1, the signal conditioner 206 preferably is mounted to the housing 34 of the refiner 30 and can be a commercially available signal conditioner that outputs an electrical current signal for each sensor that varies between four and twenty milliamps, depending on the magnitude of the measured characteristic outputted by the sensor. Where one or more sensors on board the sensor refiner disk segment 32 is a platinum RTD temperature, a signal conditioner 206 is used. Depending on the construction of the signal conditioner 206, more than one sensor can be connected to it.

In assembly, sensor-receiving bores 96, 98, 100, 102, 104, 106, 108 and 110 are formed in a refiner disk segment. Where the segment is an already formed conventional refiner disk segment, the bores 96, 98, 100, 102, 104, 106, 108 and 110 are formed using a metal removal process, preferably an EDM machining process, that converts the conventional disk segment into a sensor refiner disk 32.

Sensors 78, 80, 82, 84, 86, 88, 90 and 92 for the sensor disk segment 32 are then selected. Where it is needed to assemble sensors before inserting them into the bores 96, 98, 100, 102, 104, 106, 108 and 110 of the segment 32, preassembly of the sensors is performed. At least where temperature sensors are used, the sensing element 142 of each sensor is disposed inside a housing 140 and attached to the housing 140, preferably using an adhesive. Each sensor or housing 140 of each sensor is inserted at least partially into and attached to a spacer 114, such as by using an adhesive. Where a manifold-like fixture is used, such as fixture 116, the sensors and spacers can be assembled to the fixture before calibrating the sensors.

The selected sensors 78, 80, 82, 84, 86, 88, 90 and 92 are each calibrated to obtain at least one calibration constant for each sensor. Where one or more of the sensors 78, 80, 82, 84, 86, 88, 90 and 92 comprise temperature sensors, a slope offset calibration constant, $C_1$, and an intercept offset calibration constant, $C_2$, preferably are determined by calibration and stored for each such sensor. While each of the sensors 78, 80, 82, 84, 86, 88, 90 and 92 can be calibrated after being assembled to the sensor disk segment 32, each sensor 78, 80, 82, 84, 86, 88, 90 and 92 preferably is calibrated before being assembled to the disk segment 32. The calibration constants for the selected group of sensors 78, 80, 82, 84, 86, 88, 90 and 92 are stored on a calibration module 160. At least one calibration constant preferably is stored for each sensor.

The calibration module 160 and the assembled sensor refiner disk segment 32 are preferably put in the same package, such as a box (not shown), and shipped together to a fiber processing plant equipped with a sensor correction system 162. The sensor refiner disk segment 32 is removed from its package, assembled to a refiner 32, and the sensor wiring 126 is connected to a signal conditioner 206, if one is used. The module 160 is removed from the same package and plugged into a port, such as port 180, of a connector box 176 or the processing device 164.

The port 180 preferably is the port associated with the particular refiner 30 into which the sensor disk segment 32 has been installed. In this manner, it is assured that the right calibration data for the sensors 78, 80, 82, 84, 86, 88, 90 and 92 of a particular sensor disk segment 32 is read from the right calibration module 160. In another method of making sure that the proper calibration data is applied to the sensors 78, 80, 82, 84, 86, 88, 90 and 92 of a particular sensor disk segment 32, any port into which the module 160 is plugged can be assigned to a particular sensor disk segment 32 of a particular refiner 30. For example, each calibration module 160 preferably can be configured with its own unique memory address that can be selected using software, such as control software or another type software that processes sensor measurements, to read the calibration data from a specific module 160.

When the sensor disk segment 32 becomes worn or is scheduled for replacement, it is removed from the refiner 30, and its associated calibration module 160 is also unplugged and removed. Thereafter, a new sensor disk segment 32 is installed along with the calibration module 160 that was shipped with it. If desired, the sensors 78, 80, 82, 84, 86, 88, 90 and 92 of the spent segment 32 can be removed and reused along with its associated calibration module 160.

In operation, the sensors 78, 80, 82, 84, 86, 88, 90 and 92 of the sensor disk segment 32 of each refiner 30*a* and 30*b* sense a particular parameter in their respective refining zone during refiner operation. Referring to sensor disk segment 32 of refiner 30*a*, each sensor 78, 80, 82, 84, 86, 88, 90 and 92 is read by processing device 164 and the calibration constants for each sensor 78, 80, 82, 84, 86, 88, 90 and 92 from the module 160*a* is applied to the data read from the respective sensor. Likewise, each sensor 78, 80, 82, 84, 86, 88, 90 and 92 of the sensor disk segment 32 of refiner 30*a* is read by processing device 164 and the calibration constants for each sensor 78, 80, 82, 84, 86, 88, 90 and 92 from the module 160*b* is applied to the data read from the respective sensor.

The calibration constants are read from each module before being used to correct sensor data. If desired, the calibration constants can be read at the startup of the processing device 164.

Where a temperature sensor is read and it is desired to obtain an absolute temperature measurement, at least one calibration constant is applied to the data read. Where more precise absolute temperature measurement is desired, two calibration constants are applied to the data read, preferably using Equation V above. If desired, multiple temperatures obtained from more than one temperature sensor of a single sensor disk segment 32 can be averaged to obtain an average temperature measurement in the refining zone. Preferably, the sensors 78, 80, 82, 84, 88, 90 and 92 of each sensor disk segment 32 are read in sequence by the processing device 164.

The sensor data read preferably is used to monitor and control operation of each refiner connected to processing device 164 or another processing device that communicates with processing device 164. For example, temperature sensed in the refining zone can be used to control one or more aspects of refiner operation, such as the mass flow rate of stock entering the refiner 30. Pressure sensed in the refining zone can also be used to control one or more aspects of refiner operation, such as the mass flow rate of stock entering the refiner 30, the plate pressure, refiner gap, or another parameter.

It is also to be understood that, although the foregoing description and drawings describe and illustrate in detail one or more preferred embodiments of the present invention, to those skilled in the art to which the present invention relates, the present disclosure will suggest many modifications and constructions as well as widely differing embodiments and applications without thereby departing from the spirit and scope of the invention. The present invention, therefore, is intended to be limited only by the scope of the appended claims.

What is claimed is:

1. A fiber refiner monitoring system comprising:

(a) a plurality of fiber refiners that each refine fibrous stock comprising:

(1) at least one pair of annular refiner disks that are opposed, that are spaced apart defining a refining zone therebetween containing fibrous stock during operation, that each have a fiber refining surface with the fiber refining surface of one of the refiner disks facing the fiber refining surface of the other one of the refiner disks, each refining surface including a plurality of upraised refiner bars that each have an axial outer surface and a plurality of grooves that are each defined by a pair of adjacent refiner bars and a bottom surface, and that have one of the refiner disks rotatable relative to the other one of the refiner disks;

(2) a plurality of spaced apart sensors each disposed in a bore in the refining surface of one of the refiner disks, each sensor comprising a metal tubular housing in which a temperature or pressure sensing element is disposed, the metal tubular housing having an end wall that is located adjacent to and below the axial outer surface of an adjacent refiner bar, and the sensing element disposed adjacent the end wall of the metal tubular housing; and (b) a processor linked to each sensing element of each one of the plurality of sensors of each one of the plurality of fiber refiners that is configured to interpret signals from the sensors as pertaining to a physical property of fibrous stock.

2. A fiber refiner monitoring system according to claim 1 wherein the end wall of each corresponding metal tubular housing is completely closed and narrows to a tip that is located below the axial outer surface of the adjacent refiner bar and above a bottom surface of an adjacent groove, and wherein the sensing element is disposed adjacent to and underlies the tip of the end of the metal tubular housing.

3. A fiber refiner monitoring system according to claim 1 wherein the end of the metal tubular housing is completely closed, the completely closed end of the metal tubular housing directly contacting fibrous stock slurry in the refining zone during refiner operation, and the sensing element is shielded by the metal tubular housing from contact with fibrous stock slurry in the refining zone during refiner operation.

4. A fiber refiner monitoring system according to claim 1 wherein each sensing element of each one of the plurality of sensors of each one of the plurality of fiber refiners comprises a pressure sensing element that is affixed to the metal tubular housing.

5. A fiber refiner monitoring system according to claim 1 further comprising a manifold disposed along a rear surface of the refiner disk that is located opposite the refining surface of the refiner disk in which the plurality of sensors are disposed, wherein the manifold has a body and an outwardly projecting sensor holder for each one of the plurality of sensors, and wherein each sensor extends outwardly from one of the sensor holders of the manifold.

6. A fiber refiner monitoring system according to claim 1 wherein the end wall of each metal tubular housing is closed and narrows to a tip, and wherein its sensing element is affixed to a portion of an interior surface of the metal tubular housing that underlies the tip of the end wall of the housing.

7. A fiber refiner monitoring system according to claim 1 wherein the sensing element of one of the plurality of sensors of each one of the plurality of fiber refiners comprises a temperature sensing element, and its corresponding metal tubular housing (1) is disposed in one of the bores in the fiber refining surface of the one of the refiner disks below the fiber refining surface, (2) includes a thermally conductive rounded end, and (3) prevents the temperature sensing element from contacting fibrous stock slurry in the refining zone during refiner operation.

8. A fiber refiner monitoring system according to claim 1 wherein the end wall of each metal tubular housing is closed and narrows to a tip, and wherein the sensing element disposed in the metal tubular housing is affixed to a portion of an interior surface of the metal tubular housing that underlies the tip of the end of the housing; and further comprising a manifold disposed along a rear surface of the refiner disk that is located opposite the refining surface of the refiner disk in which the plurality of sensors are disposed, wherein the manifold has a hollow conduit and an outwardly projecting tubular sensor holder for each one of the plurality of sensors, and wherein each sensor extends outwardly from one of the sensor holders of the manifold.

9. A fiber refiner monitoring system comprising:

(a) a plurality of fiber refiners that each refine fibrous stock comprising:

(1) at least one pair of annular refiner disks that are opposed, that are spaced apart defining a refining zone therebetween containing fibrous stock during operation, that each have a fiber refining surface with the fiber refining surface of one of the refiner disks facing the fiber refining surface of the other one of the refiner disks, and that have one of the refiner disks rotatable relative to the other one of the refiner disks;

(2) a plurality of spaced apart sensors each disposed in a through bore in the refining surface of one of the refiner disks that extends completely through the one of the refiner disks, with each sensor comprising a temperature sensing element received in a hollow cylindrical housing disposed in one of the through bores in the one of the refiner disks, and the hollow cylindrical housing having a closed end disposed adjacent to and lower than the refining surface that tapers to a tip, wherein the temperature sensing element is affixed to an interior surface of the hollow cylindrical housing adjacent the tip of the closed end of the hollow cylindrical housing;

(3) a sensor holding fixture disposed along a backside of the one of the refiner disks, the sensor holding fixture comprising a plurality of outwardly projecting and spaced apart tubular sensor holders that each extend into one of the through bores in the one of the refiner disks and that each holds one of the sensors;

(b) a processor linked to each one of the plurality of sensors of each one of the plurality of fiber refiners.

10. A fiber refiner monitoring system according to claim 9 wherein each hollow cylindrical housing (1) is disposed in one of the through bores in the one of the refiner disks with its tip located below the refining surface of the one of the refiner disks, (2) has its closed end thermally conductive and rounded to the tip, and (3) prevents the temperature sensing element disposed therein from contacting fibrous stock slurry in the refining zone during refiner operation.

11. A fiber refiner monitoring system according to claim 9 wherein each hollow cylindrical housing extends from one of the sensor holders.

12. A fiber refiner monitoring system according to claim 11 wherein each sensor holder is wider than the hollow cylindrical housing extending therefrom.

13. A fiber refiner monitoring system according to claim 11 wherein each sensor holder and each hollow cylindrical housing are comprised of metal.

14. A fiber refiner monitoring system according to claim 9 wherein each hollow cylindrical housing, including its closed end that tapers to the tip, is of one-piece and unitary construction, wherein the sensor holding fixture comprises a hollow conduit that is received in a pocket formed in the backside of the one of the refiner disks with each one of the tubular sensor holders extending outwardly from the hollow conduit, and wherein each temperature sensing element has a plurality of wires extending therefrom that each threads through an opening at an end of its respective hollow cylindrical housing opposite its closed end, through its associated tubular sensor holder, and through the hollow conduit of the sensor holding fixture.

15. A fiber refiner monitoring system comprising:

(a) a plurality of fiber refiners that each refine fibrous stock comprising:

(1) at least one pair of annular refiner disks that are opposed, that are spaced apart defining a refining zone therebetween containing fibrous stock during operation, that each have a fiber refining surface with the fiber refining surface of one of the refiner disks facing the fiber refining surface of the other one of the refiner disks, and that have one of the refiner disks rotatable relative to the other one of the refiner disks;

(2) a plurality of spaced apart sensors carried by the refining surface of one of the refiner disks;

(b) a plurality of signal conditioners with one of the plurality of signal conditioners disposed onboard one of the plurality of fiber refiners and linked to the plurality of sensors of the one of the plurality of fiber refiners and another one of the plurality of signal conditioners disposed onboard of another one of the plurality of fiber refiners and linked to the plurality of sensors of the another one of the plurality of fiber refiners; and (c) a processor linked to the plurality of signal conditioners.

16. A fiber refiner monitoring system comprising:

(a) a plurality of fiber refiners that each refine fibrous stock comprising:

(1) at least one pair of annular refiner disks that are opposed, that are spaced apart defining a refining zone therebetween containing fibrous stock during operation, that each have a fiber refining surface with the fiber refining surface of one of the refiner disks facing the fiber refining surface of the other one of the refiner disks, and that have one of the refiner disks rotatable relative to the other one of the refiner disks;

(2) a plurality of spaced apart sensors carried by the refining surface of one of the refiner disks;

(b) a plurality of signal conditioners wirelessly linked to the plurality of sensors of the one of the plurality of fiber refiners and another one of the plurality of signal conditioners wirelessly linked to the plurality of sensors of the another one of the plurality of fiber refiners; and (c) a processor linked to the plurality of signal conditioners.

17. A fiber refiner monitoring system comprising:

(a) a plurality of fiber refiners that each refine fibrous stock comprising:

(1) at least one pair of annular refiner disks that are opposed, that are spaced apart defining a refining zone therebetween containing fibrous stock during operation, that each have a fiber refining surface with the fiber refining surface of one of the refiner disks facing the fiber refining surface of the other one of the refiner disks, and that have one of the refiner disks rotatable relative to the other one of the refiner disks;

(2) a plurality of spaced apart sensors carried by the refining surface of one of the refiner disks; and (b) a processor linked to the plurality of sensors of each one of the plurality of fiber refiners that is configured to read at least one sensor calibration value and interpret signals from the sensors using the at least one sensor calibration value.

18. A fiber refiner monitoring system comprising:

(a) a plurality of fiber refiners that each refine fibrous stock comprising:

(1) at least one pair of annular refiner disks that are opposed, that are spaced apart defining a refining zone therebetween containing fibrous stock during operation, that each have a fiber refining surface with the fiber refining surface of one of the refiner disks facing the fiber refining surface of the other one of the refiner disks, and that have one of the refiner disks rotatable relative to the other one of the refiner disks;

(2) a plurality of spaced apart sensors carried by the refining surface of one of the refiner disks;

(b) a sensor calibration value storage holding a plurality of sensor calibration values; and (c) a processor linked to the plurality of sensors of each one of the plurality of fiber refiners and linked to the calibration value storage.

19. A sensor refiner disk for a rotary disk refiner of a fiber refiner monitoring system comprising:

(a) a refining surface having a plurality of upraised refiner bars with each refiner bar having an axial outer surface, a plurality of grooves each defined by a bottom wall, and a plurality of through bores that extend completely through the refiner disk;

(b) a rear surface having a pocket formed therein;

(c) a sensor disposed in each through bore with each sensor including a tubular housing received in one of the through bores and a sensing element disposed inside the tubular housing, the tubular housing closed at one end with the closed end disposed below the axial outer surface of an adjacent one of the refiner bars and disposed above the bottom wall of an adjacent one of the grooves; and (d) a sensor holder comprising a hollow conduit that is disposed in the pocket in the rear surface of the refiner disk and a plurality of tubular sensor holders that extend outwardly from the hollow conduit with each one of the sensor holders received in one of the through bores and holding one of the sensors.

20. A sensor refiner disk for a rotary disk refiner of a fiber refiner monitoring system comprising:

(a) a refining surface having a plurality of upraised refiner bars with each refiner bar having an axial outer surface, a plurality of grooves each defined by a bottom wall, a rear surface facing in a direction opposite the refining surface, and a plurality of through bores that each extend from the refining surface to the rear surface;

(b) a plurality of sensors that each have a tubular housing received in one of the through bores and a sensing element disposed inside the tubular housing, the tubular housing having an end wall that is disposed adjacent the refining surface and below the axial outer surface of an adjacent one of the refiner bars; and (c) a sensor holder disposed adjacent the rear surface of the refiner disk and rearwardly of the refining surface of the refiner disk, the sensor holder comprising a conduit and a plurality of sensor holders with one of the sensors extending from each one of the sensor holders.

21. A sensor refiner disk for a rotary disk refiner of a fiber refiner monitoring system comprising:

(a) a refining surface having a plurality of upraised refiner bars with each refiner bar having an axial outer surface, a plurality of grooves each defined by a bottom wall, a rear surface facing in a direction opposite the refining surface, and a plurality of through bores that each extend from the refining surface to the rear surface;

(b) a plurality of sensors that each have a tubular housing received in one of the through bores and a sensing element disposed inside the tubular housing, the tubular housing having a end wall that that tapers to a tip that is disposed adjacent the refining surface and below the axial outer surface of an adjacent one of the refiner bars; and (c) a sensor holder affixed to the rear surface of the refiner disk, the sensor holder comprising a conduit and a plurality of tubular sensor holders that each extend outwardly into one of the through bores and hold one of the sensors.

22. A sensor refiner disk for a rotary disk refiner of a fiber refiner monitoring system comprising:

(a) a refining surface having a plurality of upraised refiner bars with each refiner bar having an axial outer surface, a plurality of grooves each defined by a bottom wall, a rear surface facing in a direction opposite the refining surface, and a plurality of through bores that each extend from the refining surface to the rear surface;

(b) a plurality of sensors that each have a tubular thermally conductive metal housing received in one of the through bores and a temperature sensing element disposed inside the tubular housing, the tubular housing having a closed end that tapers to a tip that is disposed adjacent the refining surface and below the axial outer surface of an adjacent one of the refiner bars, and the temperature sensing element being affixed to an interior surface of the housing adjacent the tip of the closed end of the housing;

(c) a sensor holder that is carried by the refiner disk adjacent the rear surface of the refiner disk, the sensor holder comprising a conduit and a plurality of sensor holders that each extend into one of the through bores and hold one of the sensors; and (d) wherein each temperature sensing element has a plurality of wires that pass through its respective tubular housing, pass through the sensor holder that holds the sensor, and passes through the conduit of the sensor holder.

23. A sensor refiner disk for a rotary disk refiner of a fiber refiner monitoring system comprising:

(a) a refining surface having a plurality of upraised refiner bars with each refiner bar having an axial outer surface, a plurality of grooves each defined by a bottom wall, a rear surface facing in a direction opposite the refining surface, and a plurality of through bores that each extend from the refining surface to the rear surface;

(b) a plurality of sensors that each have a tubular thermally conductive metal housing received in one of the through bores and a temperature sensing element disposed inside the tubular housing, the tubular housing having a closed end that tapers to a tip that is disposed adjacent the refining surface and below the axial outer surface of an adjacent one of the refiner bars such that it is exposed to stock during refiner operation, and the temperature sensing element underlying the tip of the closed end of the housing and being shielded by the housing from contacting the stock; and (c) a sensor holder that includes a hollow conduit that is disposed adjacent the rear surface of the refiner disk and that underlies the refining surface of the refiner disk and each one of the plurality of sensors.

* * * * *